US009308628B2

(12) United States Patent
Huang

(10) Patent No.: US 9,308,628 B2
(45) Date of Patent: Apr. 12, 2016

(54) ANTI-SLIP FASTENER DRIVER

(71) Applicant: New Way Tools Co., Ltd., Taichung (TW)

(72) Inventor: Ping-Wen Huang, Taichung (TW)

(73) Assignee: New Way Tools Co., Ltd., Taichung (TW)

( * ) Notice: Subject to any disclaimer, the term of this patent is extended or adjusted under 35 U.S.C. 154(b) by 292 days.

(21) Appl. No.: 13/949,300

(22) Filed: Jul. 24, 2013

(65) Prior Publication Data

US 2014/0352501 A1 Dec. 4, 2014

(30) Foreign Application Priority Data

May 28, 2013 (TW) ..... 102118744 A

(51) Int. Cl.
*B25B 15/00* (2006.01)
*B25B 27/18* (2006.01)

(52) U.S. Cl.
CPC ..... *B25B 15/004* (2013.01); *B25B 15/005* (2013.01); *B25B 15/008* (2013.01); *B25B 27/18* (2013.01)

(58) Field of Classification Search
CPC .. B25B 15/004; B25B 15/005; B25B 15/008; B25B 27/18
USPC ..... 81/451, 441, 436, 439
See application file for complete search history.

(56) References Cited

U.S. PATENT DOCUMENTS

| | | | | |
|---|---|---|---|---|
| 685,197 | A * | 10/1901 | Barnes | 81/441 |
| 4,924,736 | A * | 5/1990 | Bonner | 81/448 |
| 6,684,741 | B2 * | 2/2004 | Blackston | 81/451 |
| 8,739,658 | B2 * | 6/2014 | Kozak et al. | 81/441 |
| 2009/0000432 | A1 * | 1/2009 | Chen | 81/451 |

* cited by examiner

*Primary Examiner* — Hadi Shakeri
(74) *Attorney, Agent, or Firm* — Alan D. Kamrath; Kamrath IP Lawfirm, P.A.

(57) ABSTRACT

An anti-slip fastener driver includes a body portion and a driving portion formed at one terminal end of the body portion. The driving portion includes at least one peripheral face. A contact face is formed at one distal end of the driving portion opposite to the body portion. The contact face is beveled and at an inner included angle less than 90 degrees to the peripheral face. The contact face is adapted to abut against a terminal section of a bottom surface of a socket formed in a fastener to increase the contact area between the socket and the anti-slip fastener driver for providing enough friction to turn the fastener.

9 Claims, 24 Drawing Sheets

ANTI-SLIP FASTENER DRIVER

BACKGROUND OF THE INVENTION

1. Field of the Invention

The present invention relates to a fastener driver and, in particular, to an anti-slip fastener driver that prevents or reduces the tendency of a driving portion to slip out of the head of a stripped screw.

2. Description of the Related Art

A screw is a threaded fastener that is used to attach a workpiece or help keep a workpiece in position. The screw has a head specially formed section on one end thereof and designed to fit a certain type of screw driver, which allows users to insert or remove the screw. A stripped or damaged screw is one on which the head is damaged and, thus, difficult or impossible to turn using conventional screw drivers. This damage of screws can occur through normal wear and tear, or by using the wrong type or size of driver for the screw.

Screws have several types of head designs, depending on the manner in which the screw is intended to be used. Some heads of the screws are more susceptible to stripping than others, particularly when being driven by machine-guided tools. The simplest and least expensive screws often are manufactured with slot heads, which can be driven with a variety of tools. These types of heads also are easily damaged if too much torque is applied, often leading to a stripped screw.

When a screw does become damaged, a user can attempt several methods to remove the stripped screw. If the stripped screw is made from a softer metal, then the user can try cutting a new slot in it with a rotary tool or removing the head of the screw with a power drill. However, it needs more tools for cutting a new slot in the stripped screw. Actually, that is too much trouble for users.

The present invention is, therefore, intended to obviate or at least alleviate the problems encountered in the prior art.

SUMMARY OF THE INVENTION

The present invention solves this need and other problems in the field of fastener drivers adapted for driving a damaged fastener by providing an anti-slip fastener driver including a body portion, and a driving portion formed at one terminal end of the body portion. The driving portion includes at least one peripheral face. A contact face is formed at one distal end of the driving portion opposite to the body portion, and the contact face is beveled and at an inner included angle less than 90 degrees to the peripheral face. Therefore, the contact face is adapted to abut against a terminal section of a bottom surface of a socket formed in a fastener to increase the contact area between the socket and the anti-slip fastener driver for providing enough friction to turn the fastener.

In a first example, one end of the driving portion opposite to the body portion has a contact face. The contact face forms an end face of the driving portion.

In particularly, the driving portion can include two contact faces. A height difference is provided between the two contact faces of the driving portion.

In a second example, the driving portion includes two driving sections each having three peripheral faces and a proximal face. The two proximal faces are connected to each other. One end of each driving section opposite to the body portion forms the contact face. The two contact faces form an end face of the distal end of the driving portion together. The two contact faces are beveled and inclined to each other. Each of the two contact faces is at an inner included angle less than 90 degrees to one of the three peripheral faces of each driving section. Each of the two contact faces includes three short sides respectively connecting with the three peripheral faces of each driving section connecting with the proximal faces of each driving section of the two contact faces together forming an outer included angle less than 90 degrees.

In a third example, the driving portion includes two driving sections each having three peripheral faces. A proximal face is located between the two driving sections. The proximal face and one of the three peripheral faces form a right angle. One end of each driving section opposite to the body portion forms the contact face. The two contact faces together form an end face of the distal end of the driving portion. One of the two contact faces is beveled and at an inner included angle less the 90 degrees to one of the three peripheral faces of one of the two driving sections. The other contact face is flat and perpendicular to one of the three peripheral faces of the other driving section. Each of the two contact faces includes three short sides respectively connecting with the three peripheral faces of each driving section, and a long side connecting with the proximal faces of each driving section. The long side of one of the two contact faces and the long side of the other contact face form an outer included angle less than 90 degrees.

In a fourth example, the driving portion includes two driving sections and a middle section arranged between the two driving sections. Each driving section has three peripheral faces. Two proximal faces are respectively formed in two opposite sides of the middle section. One end of each driving section opposite to the body portion forms the contact face. One end of the middle section opposite to the body portion has a spaced face. The two contact faces and the spaced face together form an end face of, the distal end of the driving portion. Each of the two contact faces is beveled and at the inner included angle less the 90 degrees to one of the peripheral faces of each driving section. The spaced face is flat and perpendicular to one of the peripheral faces of one of the driving section. Each of the two contact faces includes three short sides respectively connecting with the three peripheral faces of each driving section, and along side connecting with the proximal faces of the middle section. The long side of each contact face and each side of the middle section form an outer included angle less than 90 degrees.

Based on the examples above, the anti-slip fastener drivers substantially are applied in hex keys.

In others examples, the body portion includes six outer walls. One of a plurality of slots is formed between every two adjacent outer walls.

In a fifth example, the driving portion includes two driving sections. Each driving section has three peripheral faces and a proximal face. The proximal faces of the two driving sections are connected to each other. Each proximal face and the one of the three peripheral faces form an acute angle. One end of each driving section opposite to the body portion forms the contact face. The two contact faces together form an end face of the distal end of the driving portion. The two contact faces are beveled and inclined to each other. Each of the two contact faces and one of the three peripheral faces of each driving section form the inner included angle less than 90 degrees. Each of the two contact faces has three short sides respectively connecting with the three peripheral faces of each driving section, and a long side connecting with the proximal faces of each driving section. The two long sides of the two contact faces include an outer included angle less than 90 degrees.

In a sixth example, the driving portion includes two driving sections. Each driving section has three peripheral faces and a proximal face. Each peripheral face is curved. The proximal faces of the two driving sections are connected to each other. Each proximal face and the one of the three peripheral faces form an acute angle. One end of each driving section opposite to the body portion forms the contact face. The two contact faces form an end face of the distal end of the driving portion together. The two contact faces are beveled and inclined to each other. Each of the two contact faces and one of the three peripheral faces of each driving section form the inner included angle less than 90 degrees. Each of the two contact faces has three-short sides being arc shaped and respectively connecting with the three peripheral faces of each driving section, and a long side connecting with the proximal faces of each driving section. The two long sides of the two contact faces form an outer included angle less than 90 degrees.

In a seventh example, the driving portion includes two driving sections. Each driving section has three peripheral faces and a proximal face. Each peripheral face is curved. The proximal faces of the two driving sections are not connected to each other. One end of each driving section opposite to the body portion form the contact face. The two contact faces form an end face of the distal end of the driving portion together. The two contact faces are beveled and respectively connect with the two proximal faces of the two driving sections.

In an eighth example, the driving portion includes two driving sections. Each driving section has a plurality of peripheral faces and a proximal face. Every two adjacent peripheral faces form an obtuse angle and an engaging groove. The proximal faces of the two driving sections are connected to each other. Each proximal face is at an acute angle to one of the plurality of peripheral faces. One end of each driving section opposite to the body portion forms the contact face. The two contact faces form an end face of the distal end of the driving portion together. Each of the two contact faces is beveled and at an inner included angle less than 90 degrees to the one of the plurality of peripheral faces of each driving section.

In a ninth example, the driving portion includes two driving sections. Each driving section has a peripheral face and a proximal face. Each peripheral face is depressed to form a plurality of engaging grooves. The proximal faces of the two driving sections are connected to each other. Each proximal face is at an acute angle to one of the plurality of peripheral faces. One end of each driving section of the driving portion opposite to the body portion forms the contact face. The two contact faces form an end face of the distal end of the driving portion together. Each of the two contact faces is beveled and connected with the plurality of engaging groove. Each of the two contact faces is at the inner included angle less than 90 degrees to each of the plurality of peripheral faces of each driving section.

In the preferred form, one end of the body portion opposite to the driving portion forms an auxiliary driving portion. The auxiliary driving portion is formed of a ball shape and having six exterior curved faces. A neck portion is formed between the auxiliary driving and body portions and has six interior curved faces respectively connected with the six exterior curved faces of the auxiliary driving portion.

It is an object of the present invention to provide an anti-slip fastener driver adapted for driving a damaged or stripped fastener.

BRIEF DESCRIPTION OF THE DRAWINGS

The illustrative embodiments may best be described by reference to the accompanying drawings where.

Figure 1:
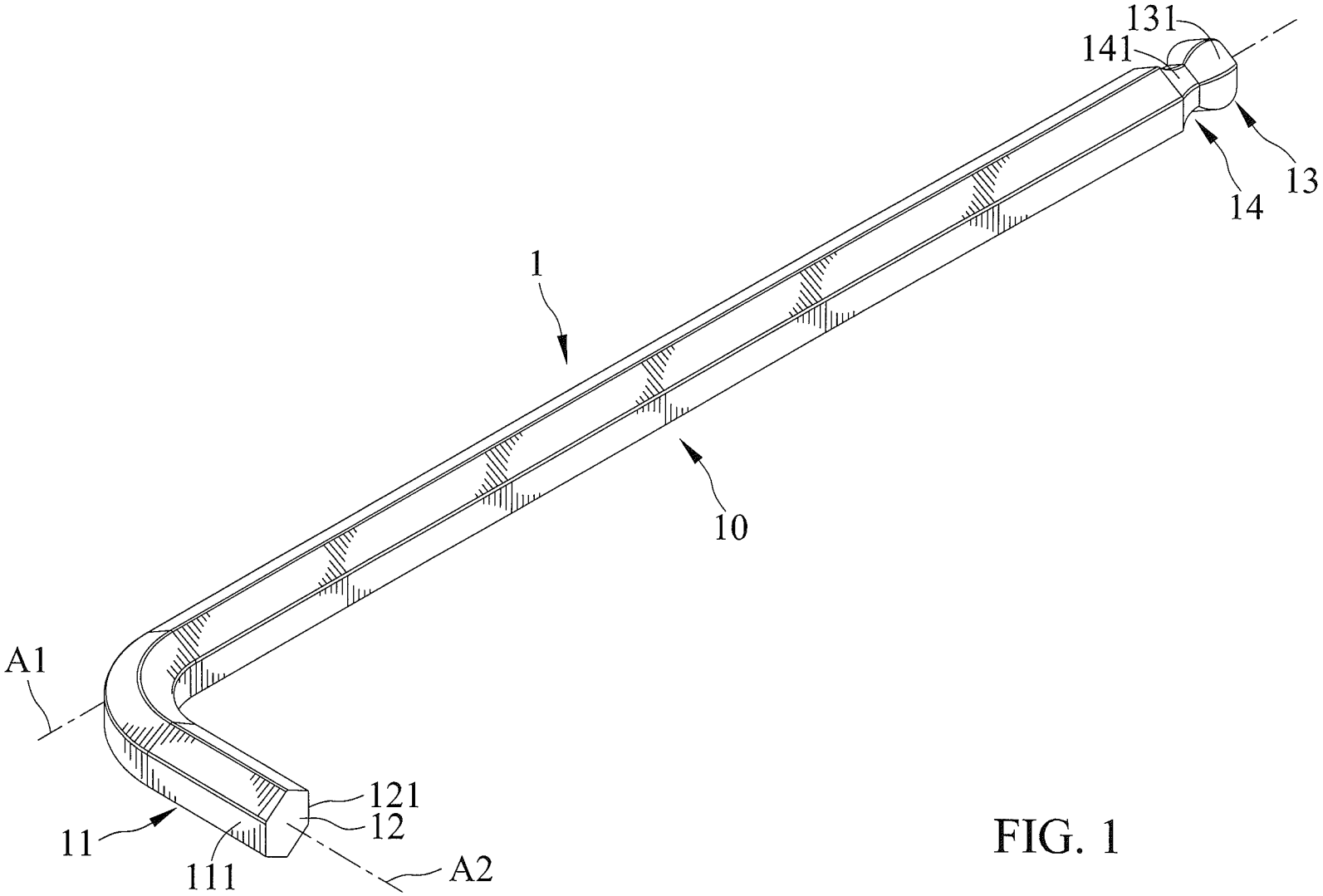
FIG. 1 shows a perspective view of an anti-slip fastener driver in accordance with a first embodiment of the present invention.
Figure 2:
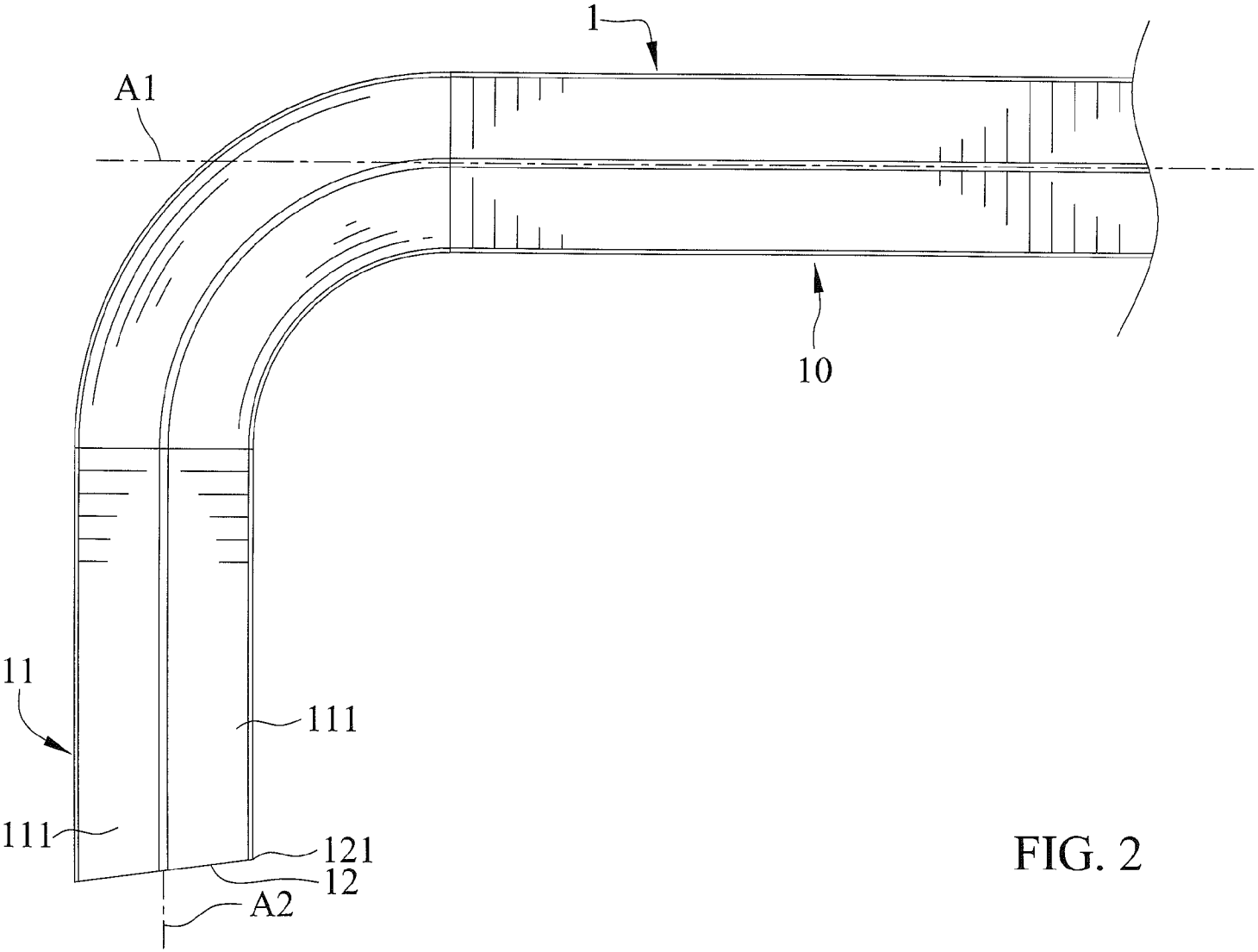
FIG. 2 shows an enlarged side view of the anti-slip fastener driver of FIG. 1.
Figure 3:
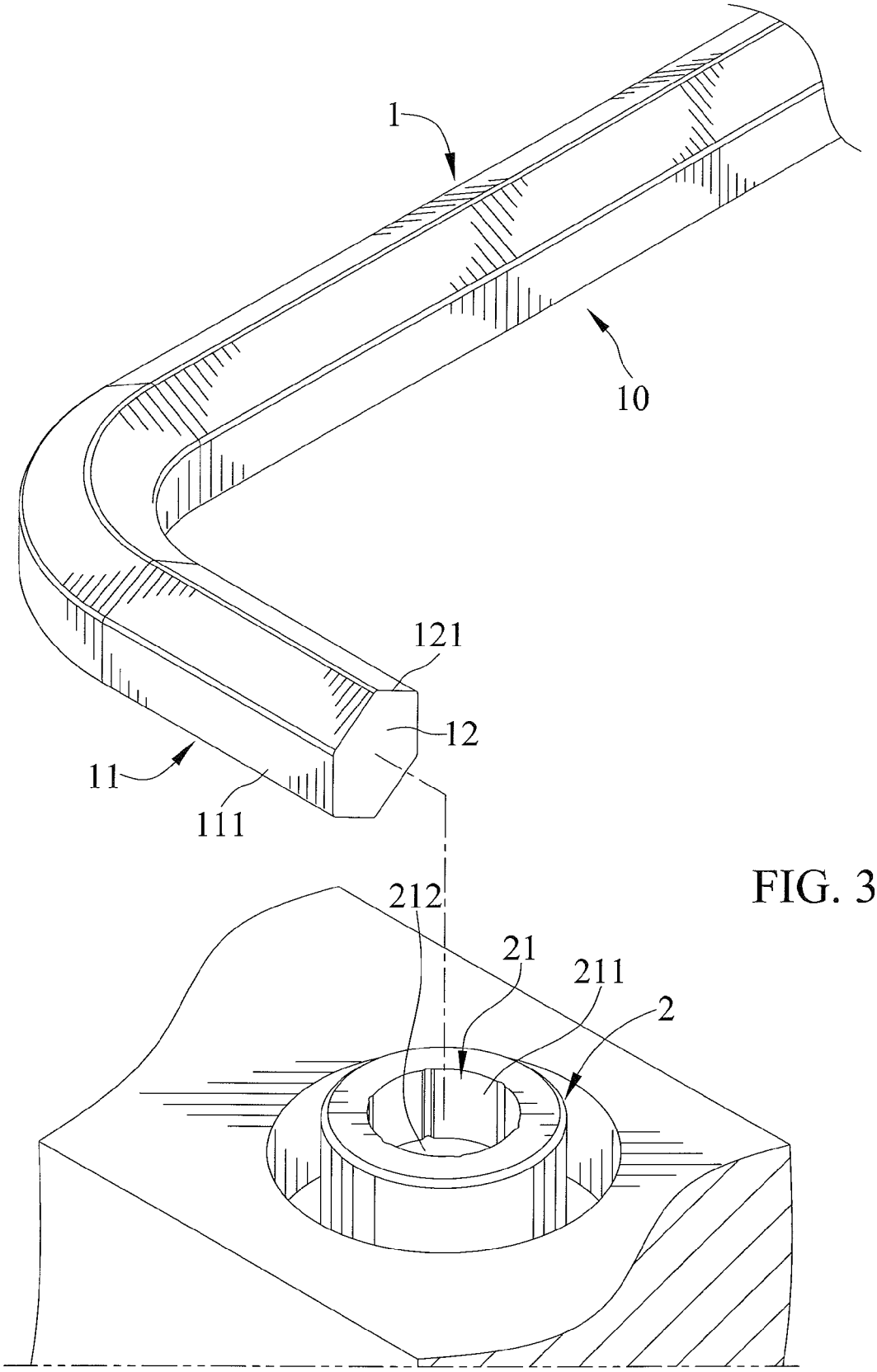
FIG. 3 shows a perspective view of the anti-slip fastener driver of FIG. 1 illustrating the anti-slip fastener driver adapted for driving a fastener.
Figure 4:
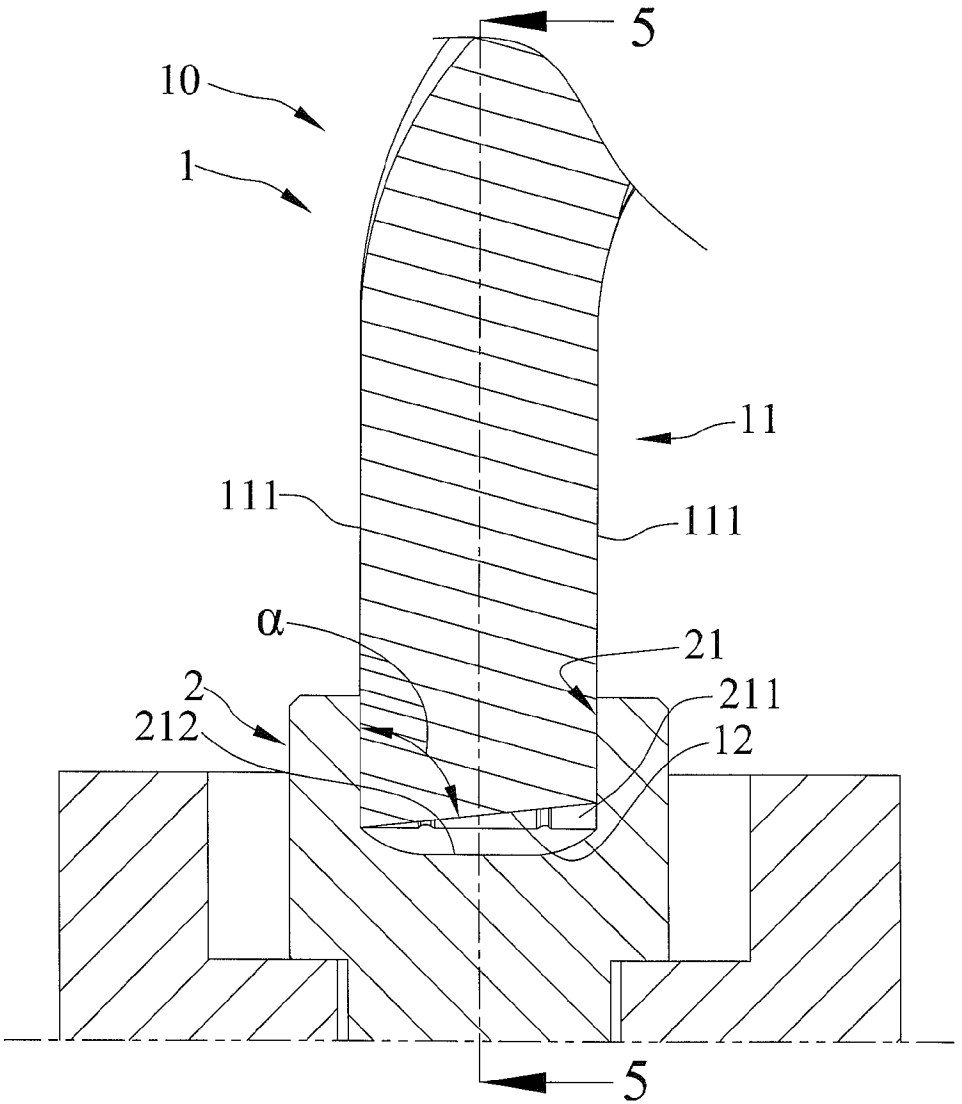
FIG. 4 shows a cross-sectional view of the anti-slip fastener driver of FIG. 1 illustrating the anti-slip fastener driver inserting into the fastener.
Figure 5:
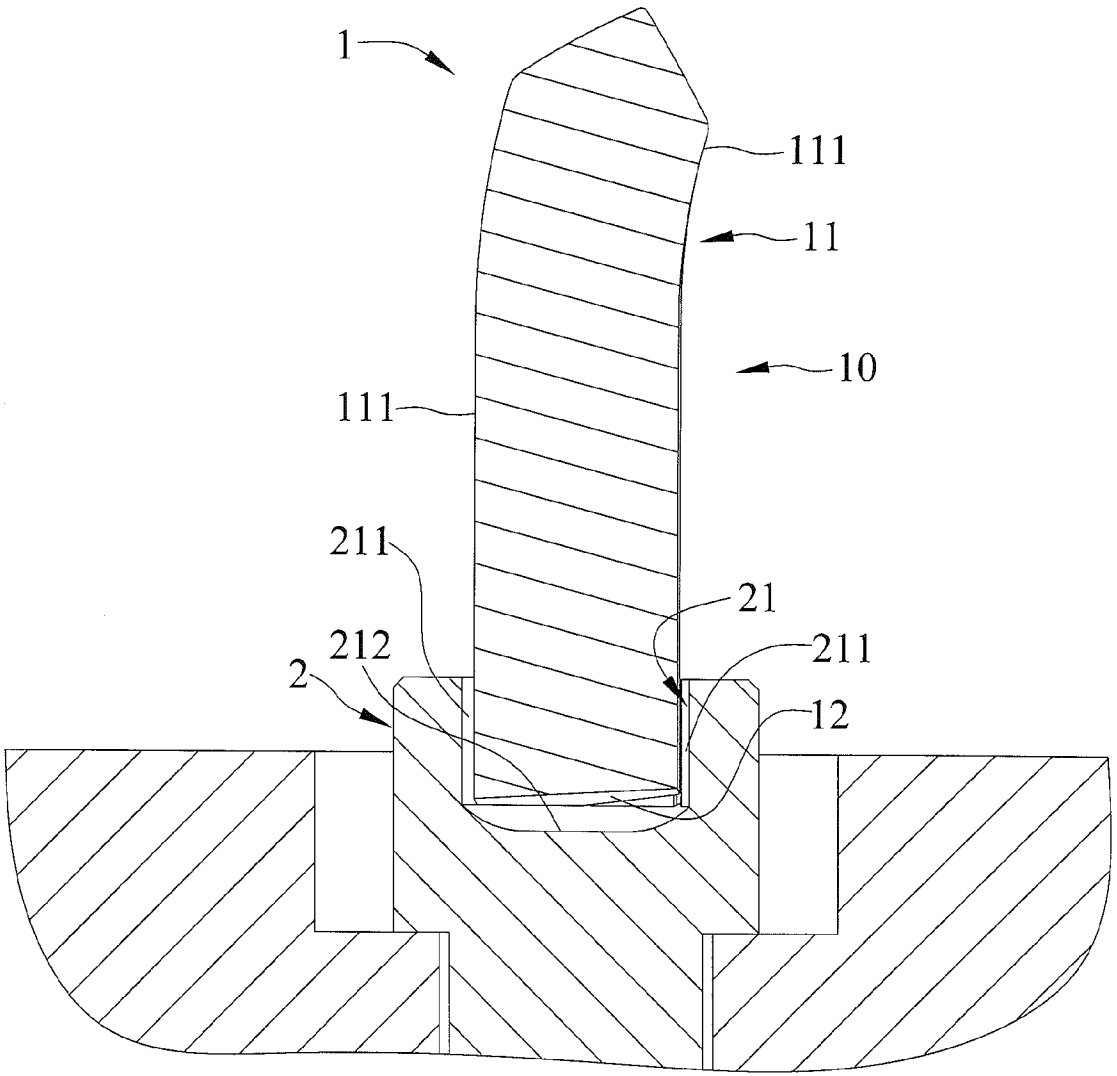
FIG. 5 shows a cross sectional view taken along section line 5-5 of FIG. 4.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "longitudinal", "clockwise", "counterclockwise", and similar terms are used herein, it should be understood that these terms have reference only to the structure shown in the drawings as it would appear to a person viewing the drawings and are utilized only to facilitate describing the invention.

DETAILED DESCRIPTION OF THE PREFERRED EMBODIMENTS

FIGS. 1 through 5 show an anti-slip fastener driver 1 in accordance with a first embodiment of the present invention includes a body portion 10 extending along a first axis A1, and a driving portion 11 provided at one end of the body portion 10 and extending along a second axis A2 perpendicular to the first axis A1. The body portion 10 has a hexagonal cross section perpendicular to the first axis A1, and the driving portion 11 has a hexagonal cross section perpendicular to the second axis A2 corresponding to that of the body portion 10. The driving portion 11 includes six peripheral faces 111 each extending parallel to the second axis A2. Every two adjacent peripheral faces 111 form a 120 degree angle. One end of the driving portion 11 opposite to the body portion 10 has a contact face 12. The contact face 12 forms an end face of the driving portion 11. In particular, the contact face 12 is a beveled face. The contact face 12 and one of the six peripheral faces 111 form an inner included angle $\alpha$ less than 90 degrees. The contact face 12 is enclosed by six sides 121 respectively connected with the six peripheral faces 111. One end of the body portion 10 opposite to the driving portion 11 forms an auxiliary driving portion 13 extending along the first axis A1. The auxiliary driving portion 13 is substantially formed as a ball shape and includes six exterior curved faces 131. A neck portion 14 is formed between the auxiliary driving and body portions 13 and 10 and includes six interior curved faces 141 respectively connected with the six exterior curved faces 131 of the auxiliary driving portion 13.

The anti-slip fastener driver 1 is adapted for driving a damaged or stripped fastener 2 including a socket 21 formed in a head thereof. The socket 21 is provided with six inner walls 211 therein. The six inner walls 211 are formed as curved surfaces due to the fastener 2 being damaged to cause the six peripheral faces 111 of the driving portion 11 being unable to connect closely with the six inner walls 211. The socket 21 has a bottom surface 212 formed in a cambered surface and interconnected with the six inner walls 211. When the anti-slip fastener driver 1 engages into the socket 21 of the fastener 2, moving the anti-slip fastener driver 1 causes the six peripheral faces 111 of the driving portion 11 abutting against the six inner walls 211 of the socket 21. At the same time, the contact face 12 of the anti-slip fastener driver 1 abuts against a terminal section of the bottom surface 212 of the socket 21 adjacent to one of the six inner walls 211 to increase the contact area between the socket 21 and the anti-slip fastener driver 1 for providing enough friction to turn the fastener 2. Thus, the fastener 2 is reliably turned by the anti-slip fastener driver 1.

Figure 6:
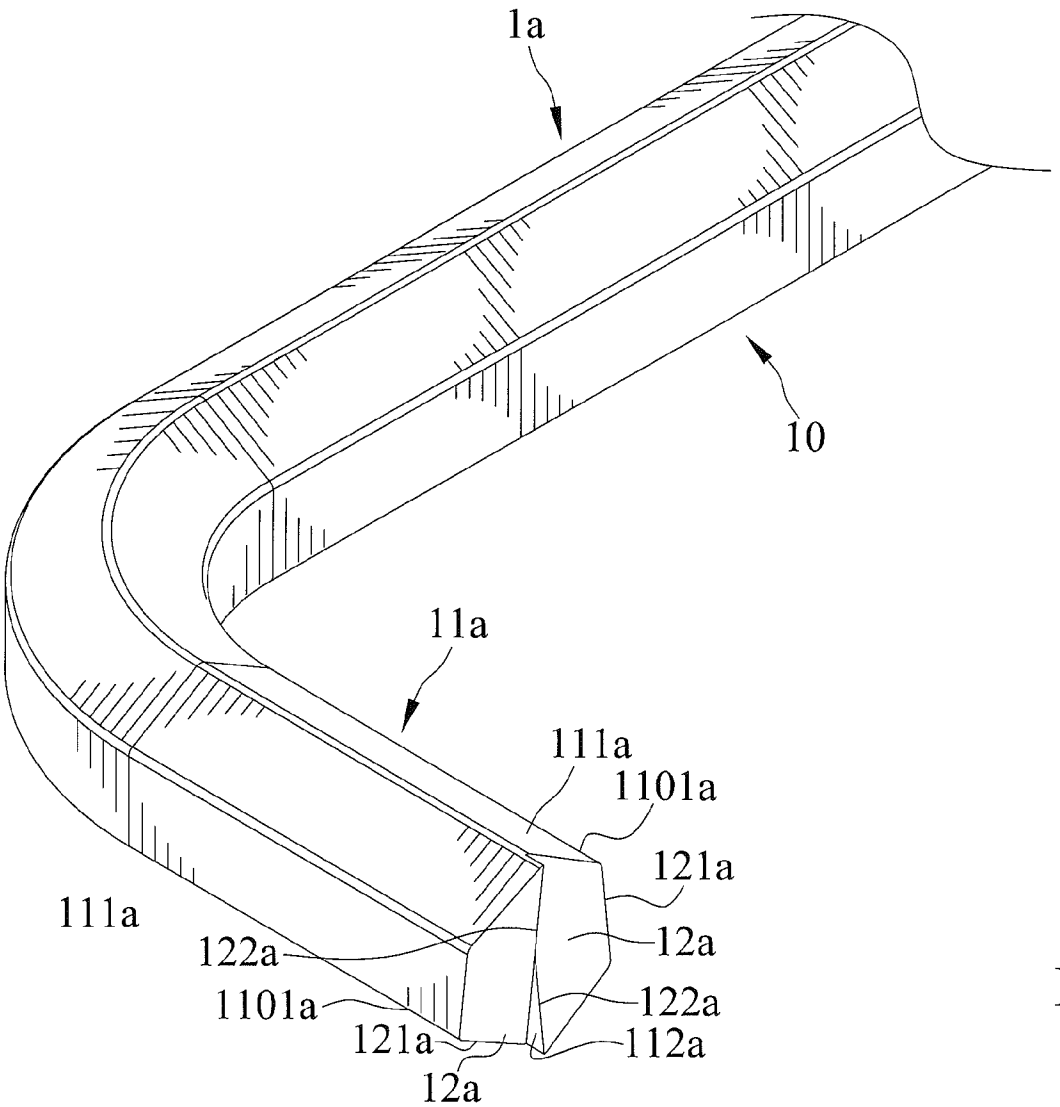
FIG. 6 shows a partial perspective view of an anti-slip fastener driver in accordance with a second embodiment of the present invention.
Figure 7:
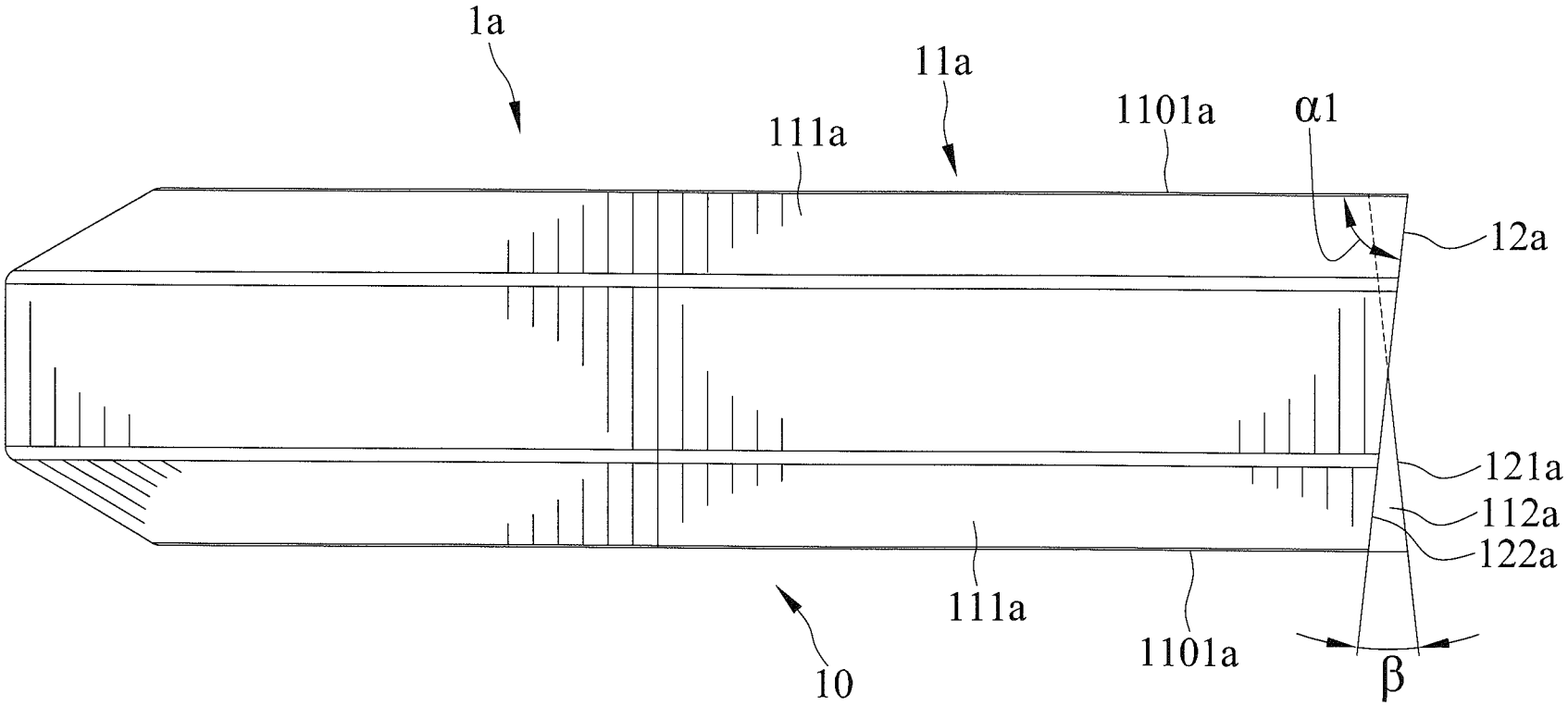
FIG. 7 shows an enlarged side view of the anti-slip fastener driver of FIG. 6.
Figure 8:
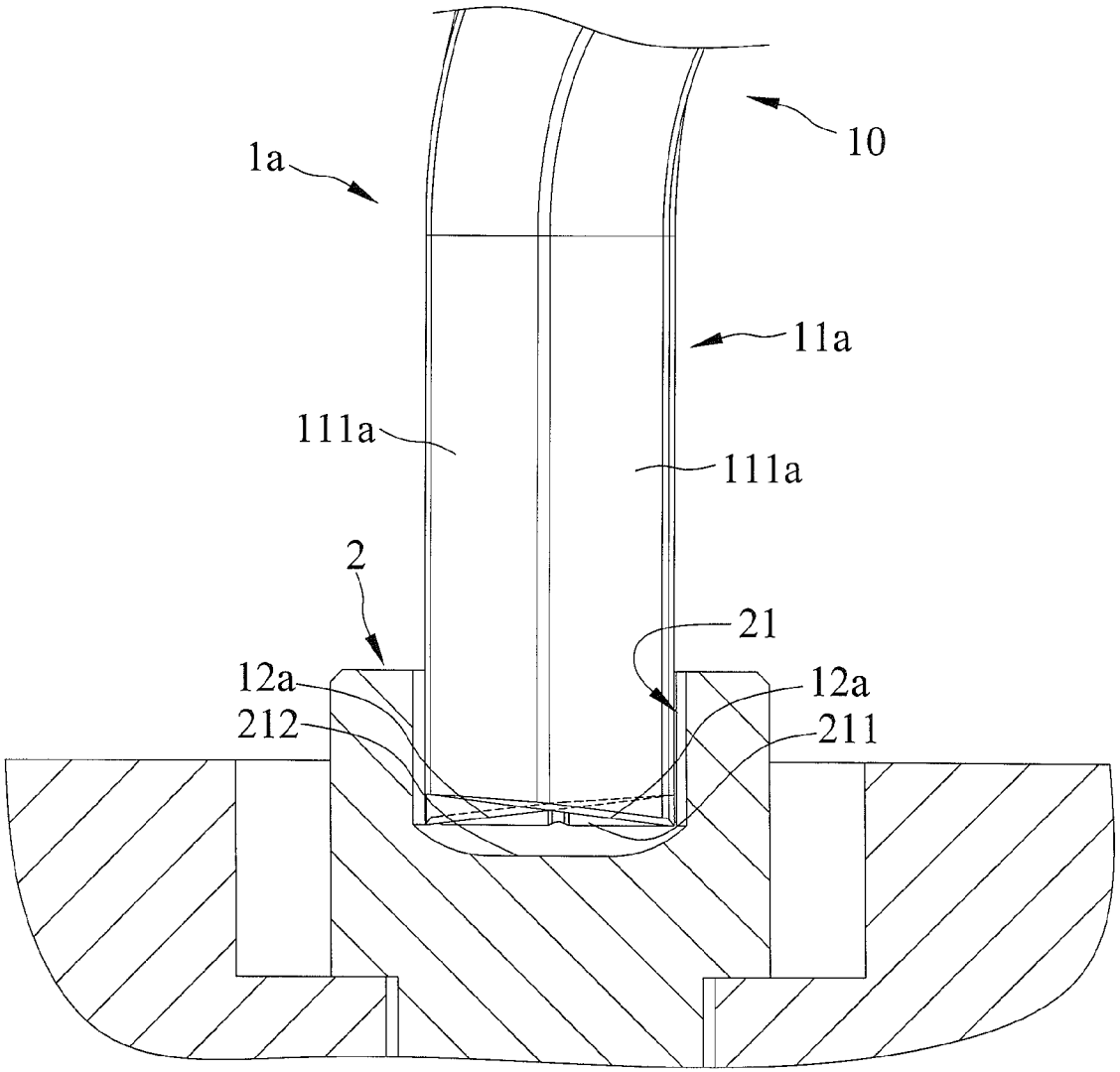
FIG. 8 shows a cross-sectional view of the anti-slip fastener driver of FIG. 6 illustrating the anti-slip fastener driver inserting into the fastener.

FIG. 6 through 8 show an anti-slip fastener driver 1*a* in accordance with a second embodiment of the present invention. The structure of the anti-slip fastener driver 1*a* of the second embodiment is substantially similar to that of the first embodiment except that the driving portion 11*a* includes two driving sections 1101*a*. Each driving section 1101*a* includes three peripheral faces 111*a* and a proximal face 112*a*. The two proximal faces 112*a* of the two driving sections 1101*a* are connected to each other. The proximal faces 112*a* of each driving section 1101*a* and one of the three peripheral faces 111*a* form an acute angle. One end of each driving section 1101*a* of the driving portion 11*a* opposite to the body portion 10 has a contact face 12*a*. The two contact faces 12*a* together form an end face of the distal end of the driving portion 11*a* with a height difference provided therebetween. In particular, the two contact faces 12*a* are beveled faces and inclined to each other. Each of the two contact faces 12*a* and one of the three peripheral faces 111*a* of each driving section 1101*a* form an inner included angle $\alpha$1 less than 90 degrees. Each of the two contact faces 12*a* includes three short sides. 121*a* respectively connecting with the three peripheral faces 111*a* of each driving section 1101*a*, and a long side 122*a* connecting with the proximal faces 112*a* of each driving section 1101*a*. The two long sides 122*a* of the two contact faces 12*a* form an outer included angle $\beta$ less than 90 degrees together.

Figure 9:
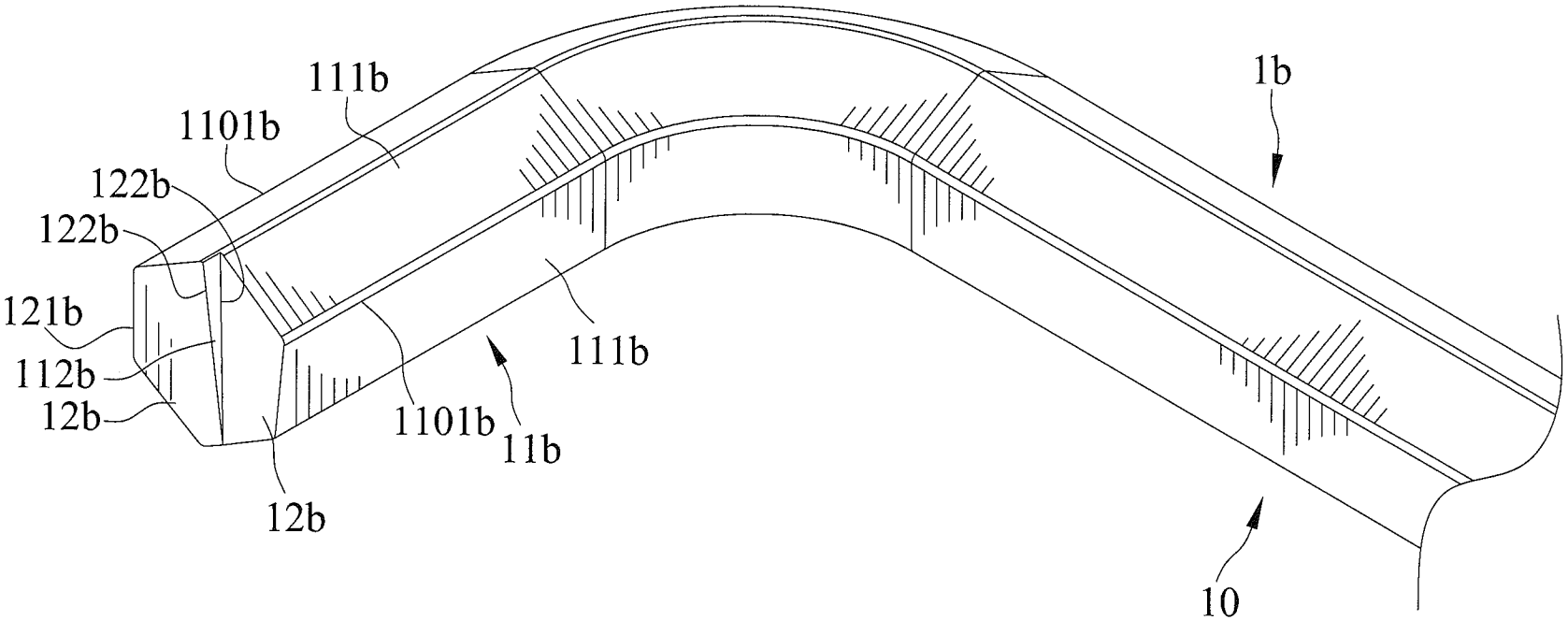
FIG. 9 shows a partial perspective view of an anti-slip fastener driver in accordance with a third embodiment of the present invention.
Figure 10:
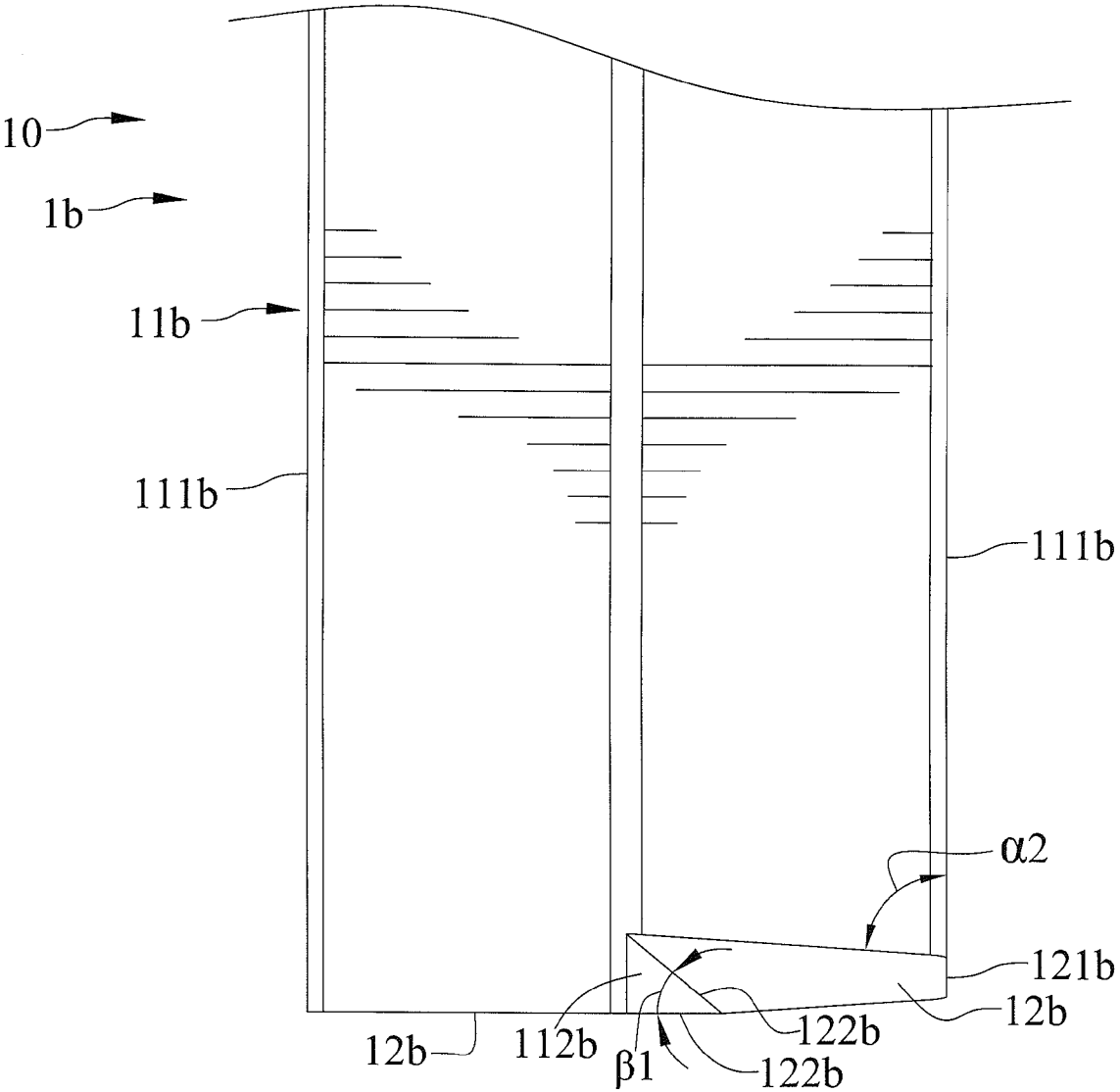
FIG. 10 shows an enlarged side view of the anti-slip fastener driver of FIG. 9.
Figure 11:
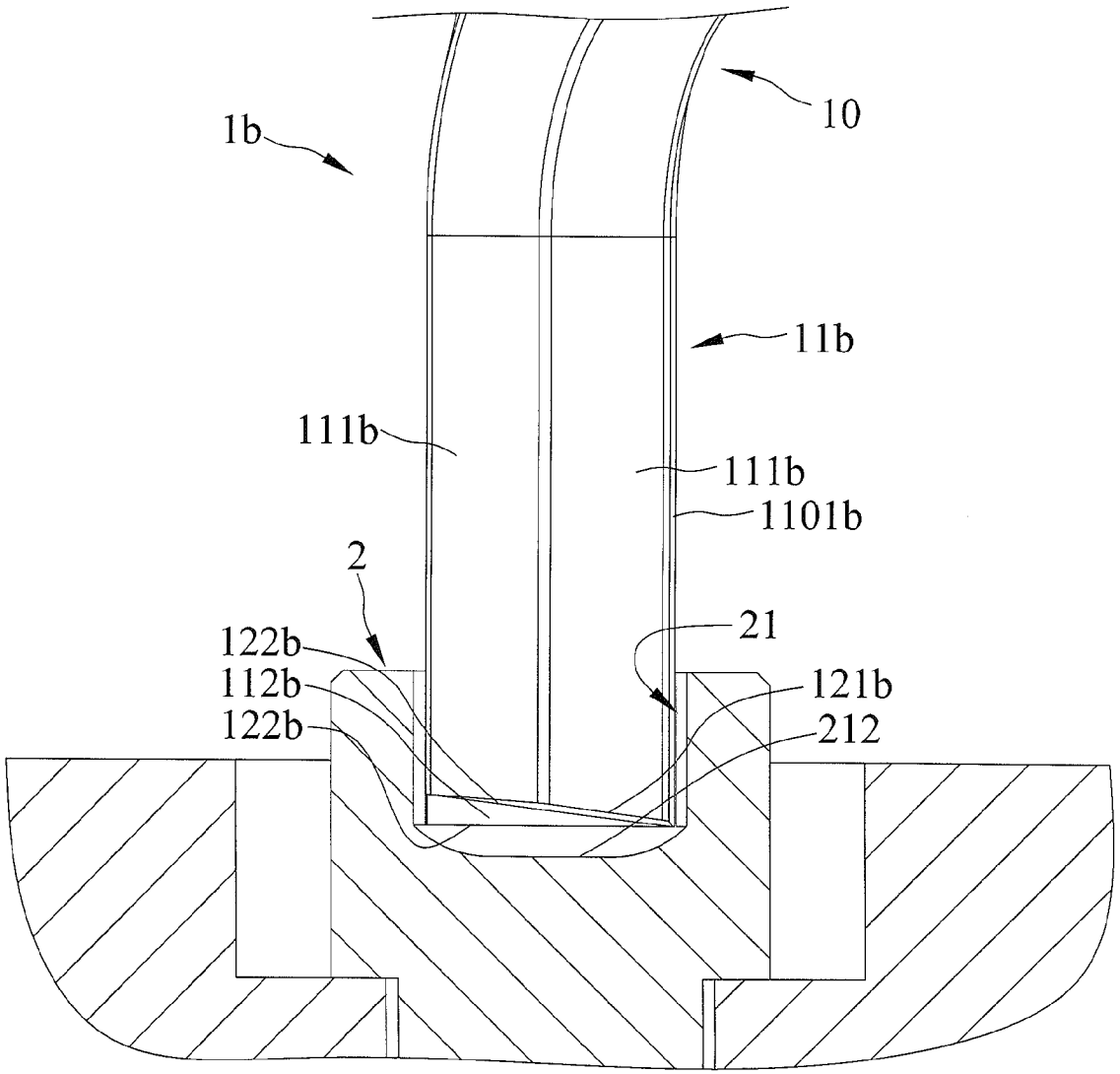
FIG. 11 shows a cross-sectional view of the anti-slip fastener driver of FIG. 9 illustrating the anti-slip fastener driver inserting into the fastener.

FIG. 9 through 11 show an anti-slip fastener driver 1*b* in accordance with a third embodiment of the present invention. The structure of the anti-slip fastener driver 1*b* of the third embodiment is substantially similar to that of the second embodiment except that the driving portion 11*b* includes two driving sections 1101*b*. Each driving section 1101*b* includes three peripheral faces 111*b*. A proximal face 112*b* is located between the two driving sections 1101*b*. The proximal face 112*b* and one of the three peripheral faces 111*b* form a right angle. One end of each driving section 1101*b* of the driving portion 11*b* opposite to the body portion 10 has a contact face 12*b*. The two contact faces 12*b* together form an end face of the distal end of the driving portion 11*b* with a height difference provided therebetween. In particular, one of the two contact faces 12*b* is a beveled face, and is at an inner included angle $\alpha$2 less the 90 degrees to one of the peripheral faces 111*b* of one of the two driving sections 1101*b*. The other contact face 12*b* is a flat face, and is perpendicular to one of the peripheral faces 111*b* of the other driving section 1101*b*. Each of the two contact faces 12*b* includes three short sides 121*b* respectively connecting with the three peripheral faces 111*b* of each driving section 1101*b*, and a long side 122*b* connecting with the proximal faces 112*b* of each driving section 1101*b*. The long side 122*b* of one of the two contact faces 12*b* and that of the other contact face 12*b* form an outer included angle $\beta$1 less than 90 degrees.

Figure 12:
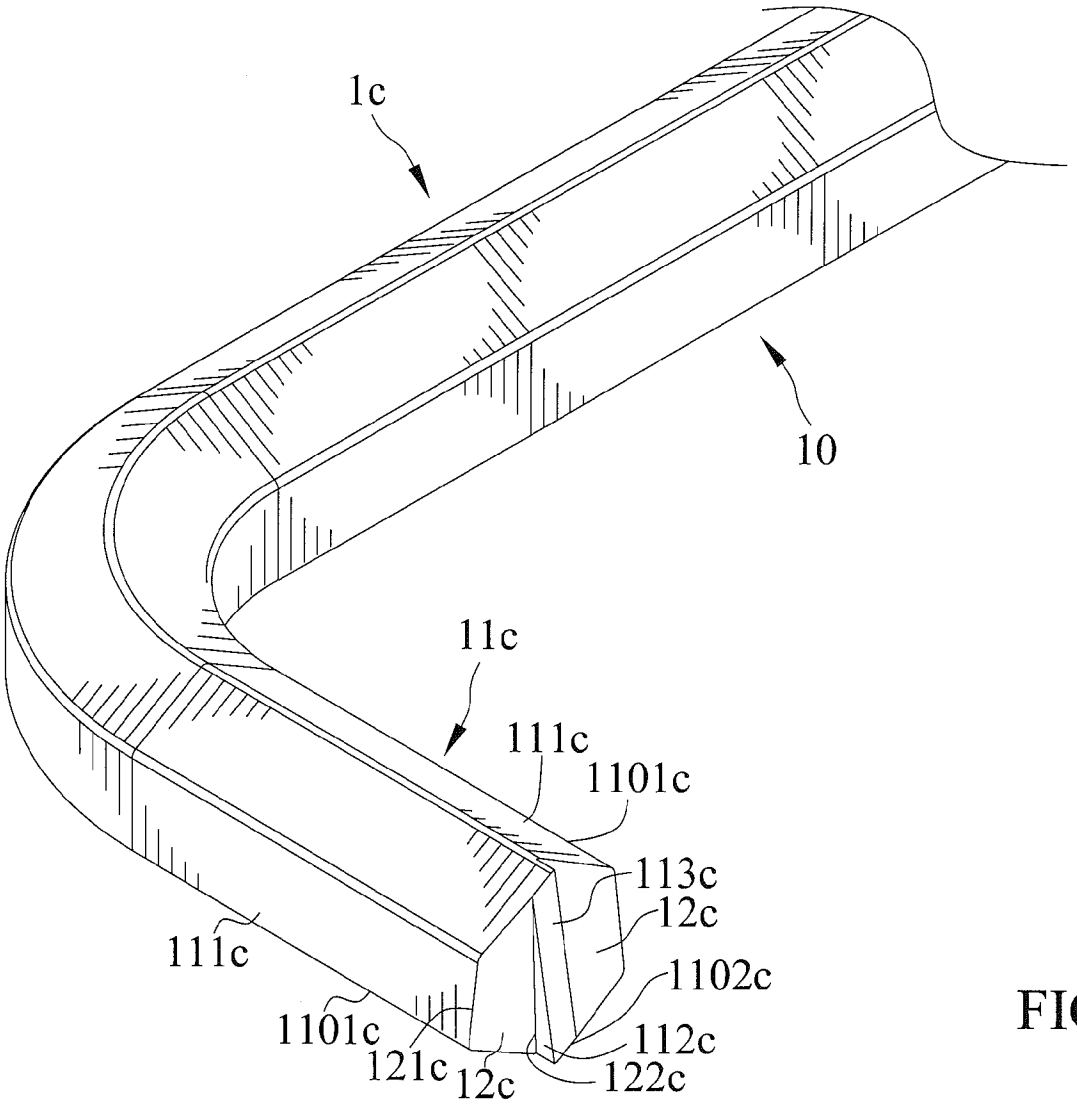
FIG. 12 shows a partial perspective view of an anti-slip fastener driver in accordance with a fourth embodiment of the present invention.
Figure 13:
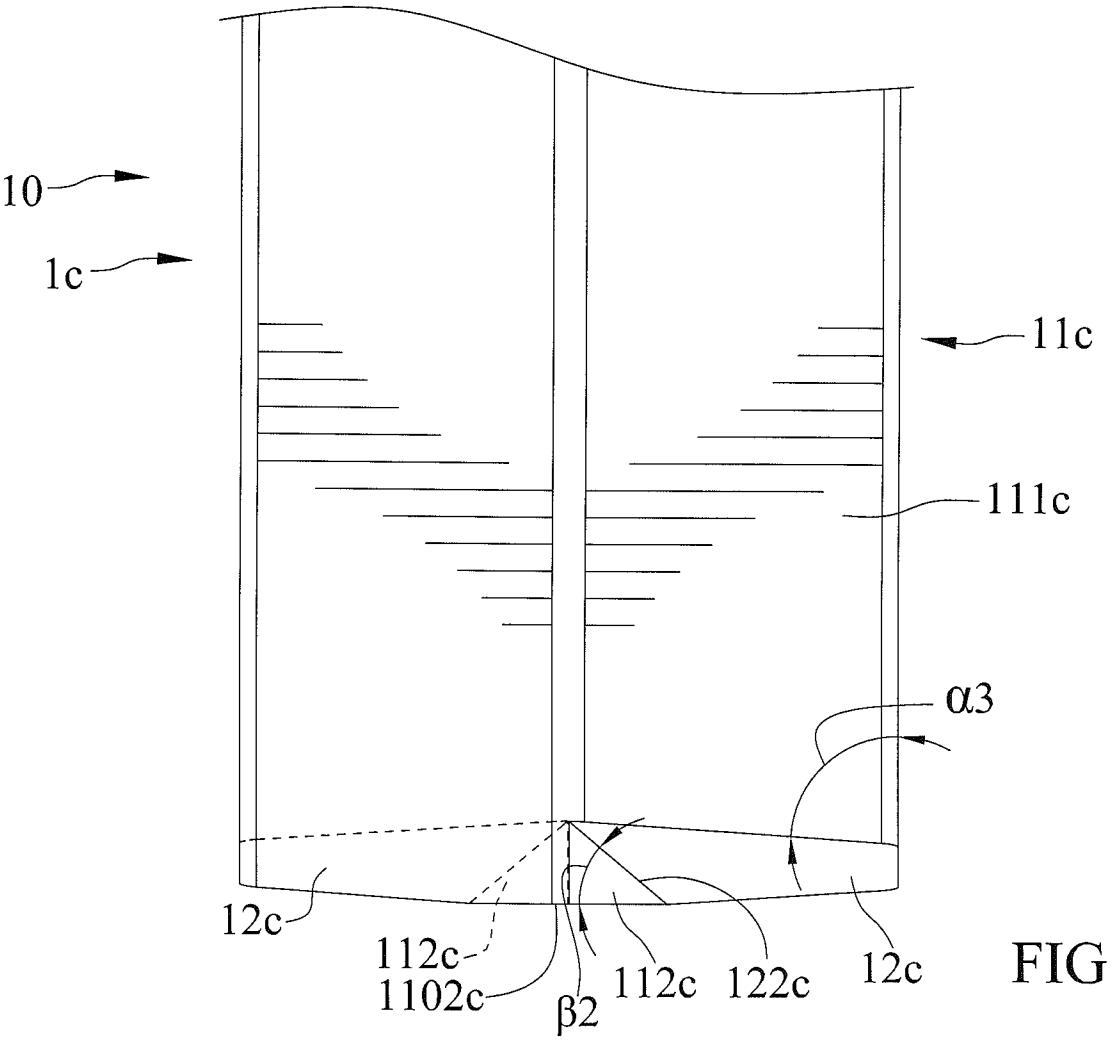
FIG. 13 shows an enlarged side view of the anti-slip fastener driver of FIG. 12.
Figure 14:
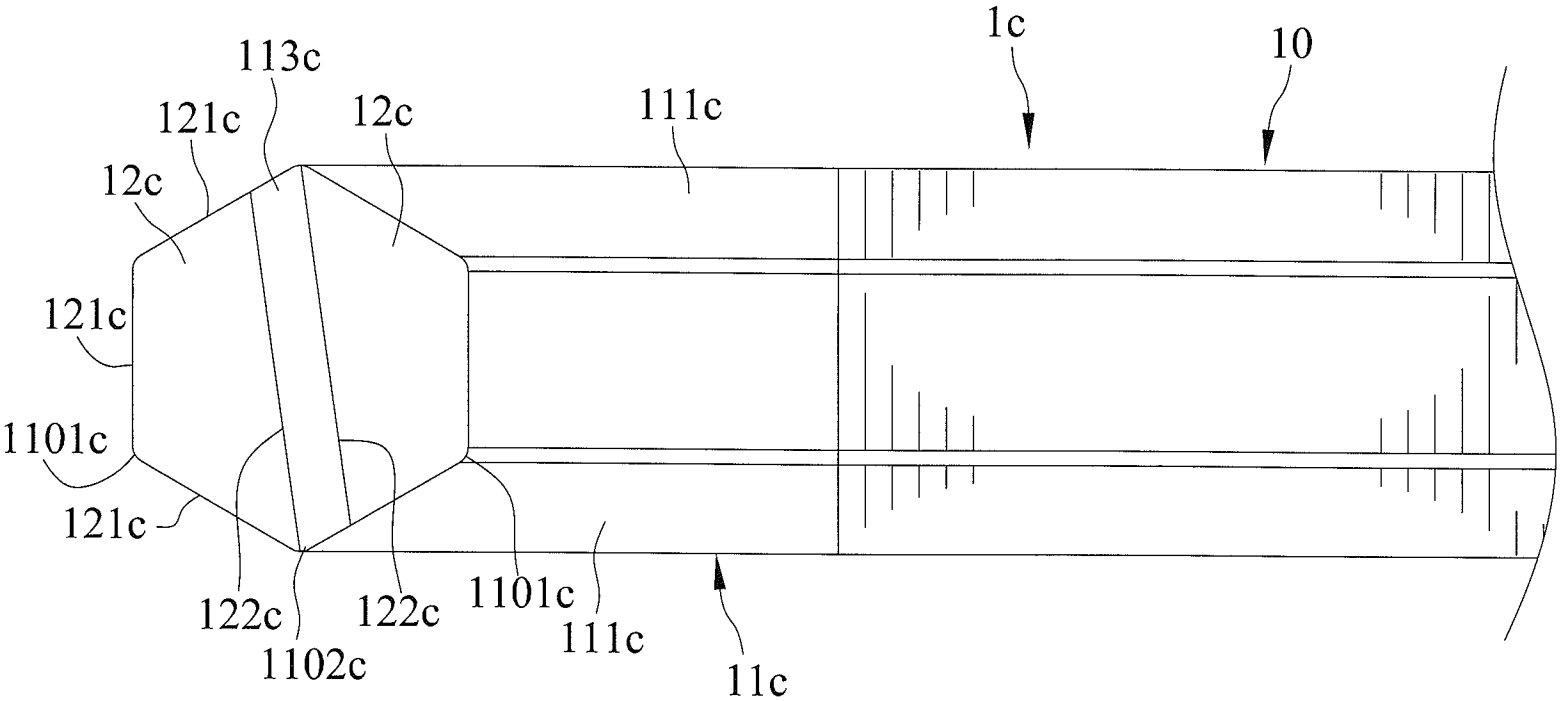
FIG. 14 shows a bottom view of the anti-slip fastener driver of FIG. 12.

FIG. 12 through 14 show an anti-slip fastener driver 1*c* in accordance with a fourth embodiment of the present invention. The structure of the anti-slip fastener driver 1*c* of the fourth embodiment is substantially similar to that of the second embodiment except that the driving portion 11*c* includes two driving sections 1101*c* and a middle section 1102*c* arranged between the two driving sections 1101*c*. Each driving section 1101*c* includes three peripheral faces 111*c*. Two proximal faces 112*c* are respectively formed in two opposite sides of the middle section 1102*c*. One end of each driving section 1101*c* of the driving portion 11*c* opposite to the body portion 10 has a contact face 12*c*. One end of the middle section 1102*c* opposite to the body portion 10 has a spaced face 113*c*. The two contact faces 12*c* and the spaced face 113*c* together form an end face of the distal end of the driving portion 11*c* with a height difference provided therebetween. In particular, each of the two contact faces 12*c* is a beveled face, and is at an inner included angle $\alpha$3 less the 90 degrees to one of the peripheral faces 111*c* of each driving section 1101*e*. The spaced face 113*c* is a flat face, and is perpendicular to one of the peripheral faces 111*c* of one of the driving section 1101*c*. Each of the two contact faces 12*c* includes three short sides 121*c* respectively connecting with the three peripheral faces 111*c* of each driving section 1101*c*, and a long side 122*c* connecting with the proximal faces 112*c* of the middle section 1102*c*. The long side 122*c* of each contact face 12*c* and each side wall of the middle section 1102*c* form an outer included angle β2 less than 90 degrees.

Based on the embodiments above, the anti-slip fastener drivers 1, 1*a*, 1*b*, and 1*c* substantially are applied in hex keys.

Figure 15:
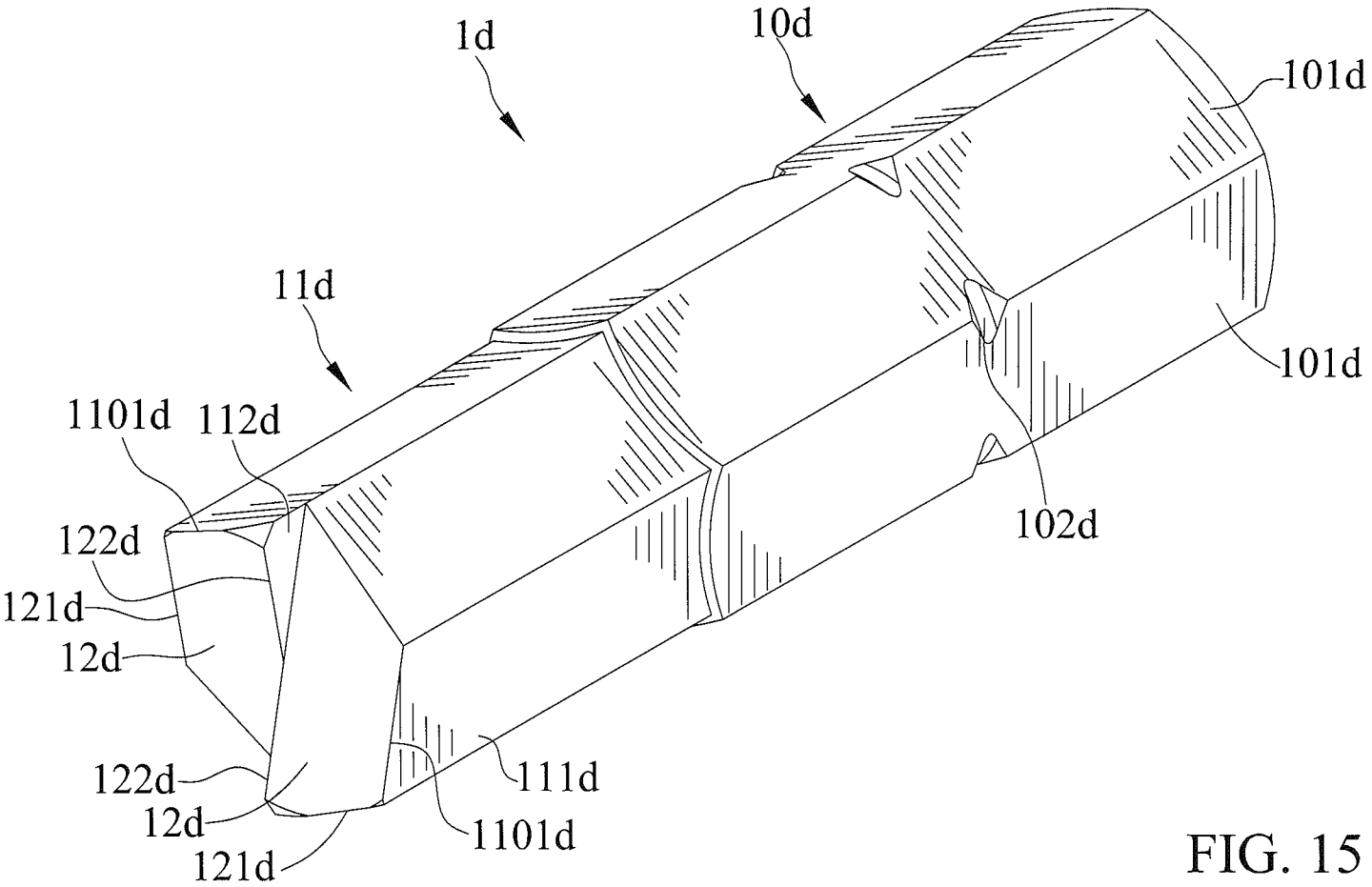
FIG. 15 shows a perspective view of an anti-slip fastener driver in accordance with a fifth embodiment of the present invention.
Figure 16:
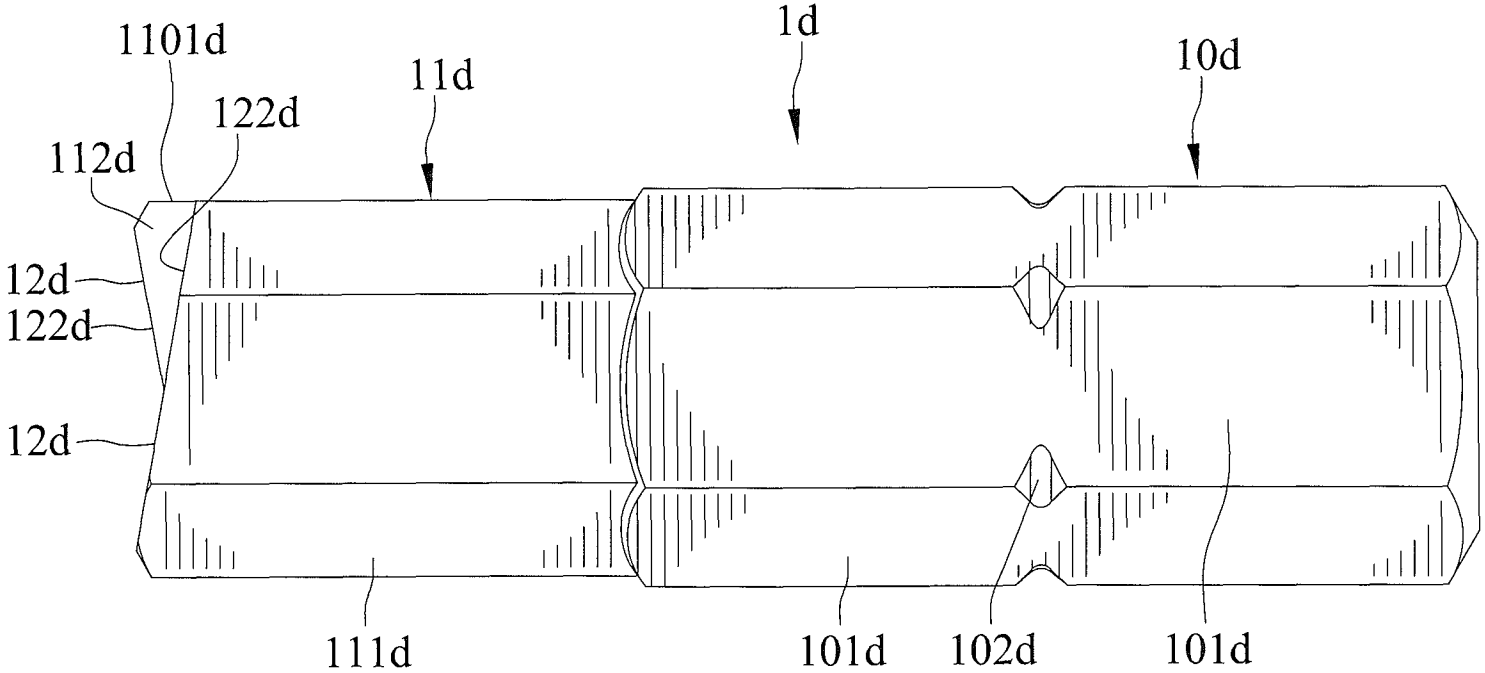
FIG. 16 shows a side view of the anti-slip fastener driver of FIG. 15.

FIGS. 15 and 16 show an anti-slip fastener driver 1*d* in accordance with a fifth embodiment of the present invention includes a body portion 10*d* and a driving portion 11*d* extending from one end of the body portion 10*d* coaxially. The body portion 10*d* includes six outer walls 101*d*. One of a plurality of slots 102*d* is formed between every two adjacent outer walls 101*d* and is adapted to connect to a driving tool, such as a power tool, a pneumatic tool, a manual tool, or the like. The driving portion 11*d* includes two driving sections 1101*d*. Each driving section 1101*d* includes three peripheral faces 111*d* and a proximal face 112*d*. The proximal faces 112*d* of the two driving sections 1101*d* are connected to each other. Each proximal face 112*d* and the one of the three peripheral faces 111*d* form an acute angle. One end of each driving section 1101*d* of the driving portion 11*d* opposite to the body portion 10*d* has a contact face 12*d*. The two contact faces 12*d* together form an end face of the distal end of the driving portion 11*d* with a height difference provided therebetween. In particular, the two contact faces 12*d* are beveled faces and inclined to each other. Each of the two contact faces 12*d* and one of the three peripheral faces 111*d* of each driving section 1101*d* form an inner included angle less than 90 degrees. Each of the two contact faces 12*d* includes three short sides 121*d* respectively connecting with the three peripheral faces 111*d* of each driving section 1101*d*, and a long side 122*d* connecting with the proximal faces 112*d* of each driving section 1101*d*. The two long sides 122*d* of the two contact faces 12*d* include an outer included angle less than 90 degrees.

Figure 17:
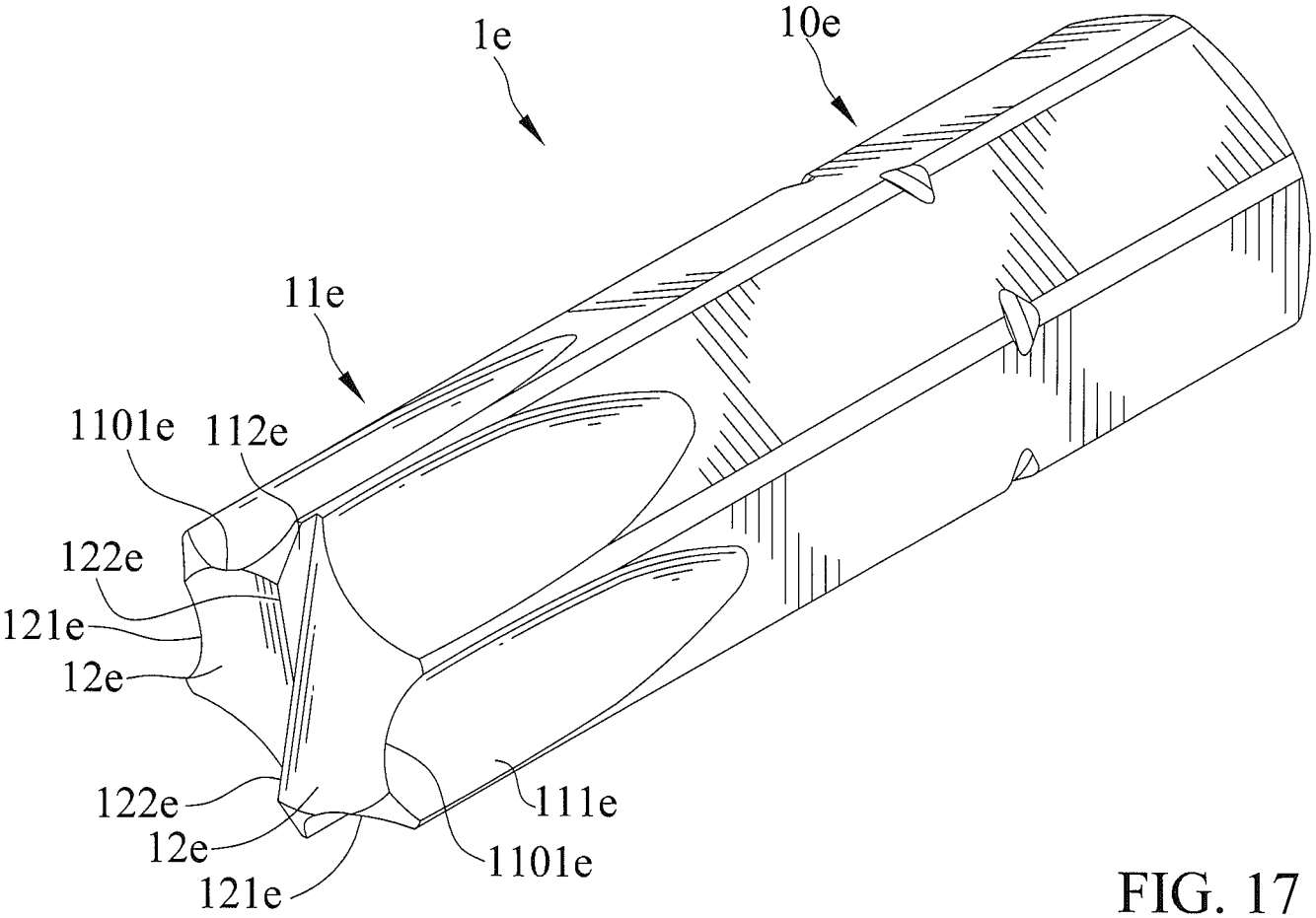
FIG. 17 shows a perspective view of an anti-slip fastener driver in accordance with a sixth embodiment of the present invention.
Figure 18:
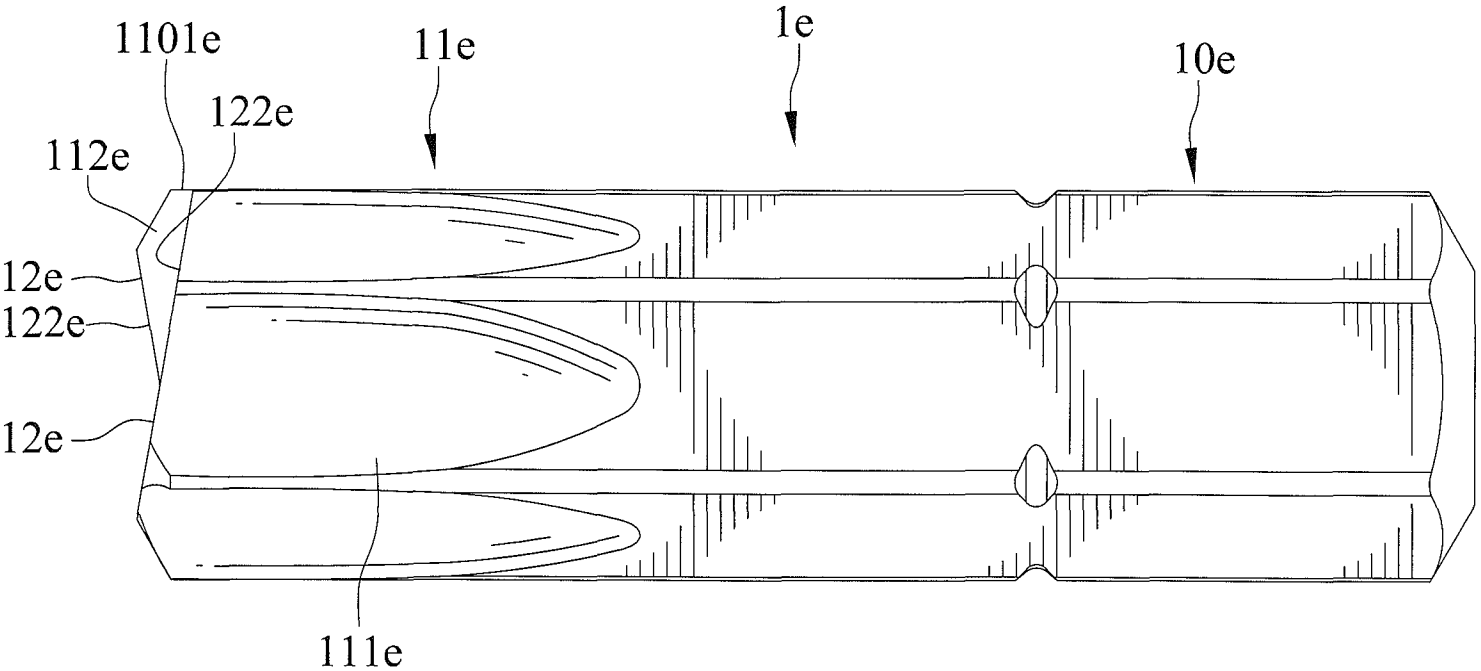
FIG. 18 shows a side view of the anti-slip fastener driver of FIG. 17.

FIGS. 17 and 18 show an anti-slip fastener driver 1*e* in accordance with a sixth embodiment of the present invention. The structure of the anti-slip fastener driver 1*e* of the sixth embodiment is substantially similar to that of the fifth embodiment except that the driving portion 11*e* includes two driving sections 1101*e*. Each driving section 1101*e* includes three peripheral faces 111*e* and a proximal face 112*e*. Each peripheral face 111*e* is a curved face. The proximal faces 112*e* of the two driving sections 1101*e* are connected to each other. Each proximal face 112*e* and the one of the three peripheral faces 111*e* form an acute angle. One end of each driving section 1101*e* of the driving portion 11*e* opposite to the body portion 10*e* has a contact face 12*e*. The two contact faces 12*e* together form an end face of the distal end of the driving portion 11*e* with a height difference provided therebetween. In particular, the two contact faces 12*e* are beveled faces and inclined to each other. Each of the two contact faces 12*e* and one of the three peripheral faces 111*e* of each driving section 1101*e* form an inner included angle less than 90 degrees. Each of the two contact faces 12*e* includes three short sides 121*e* which are arc shaped and respectively connecting with the three peripheral faces 111*e* of each driving section 1101*e*, and a long side 122*e* connecting with the proximal faces 112*e* of each driving section 1101*e*. The two long sides 122*e* of the two contact faces 12*e* form an outer included angle less than 90 degrees.

Figure 19:
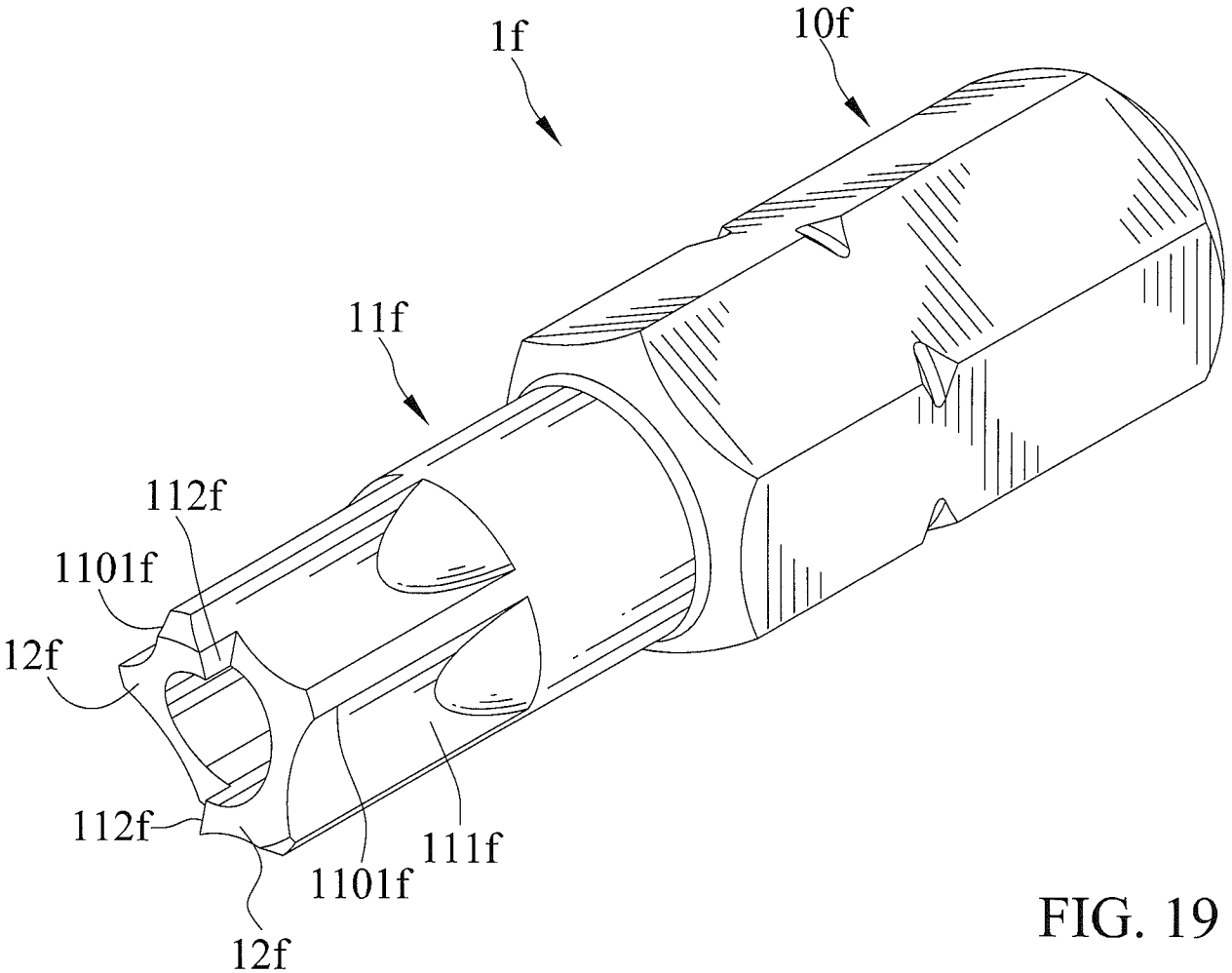
FIG. 19 shows a perspective view of an anti-slip fastener driver in accordance with a seventh embodiment of the present invention.
Figure 20:
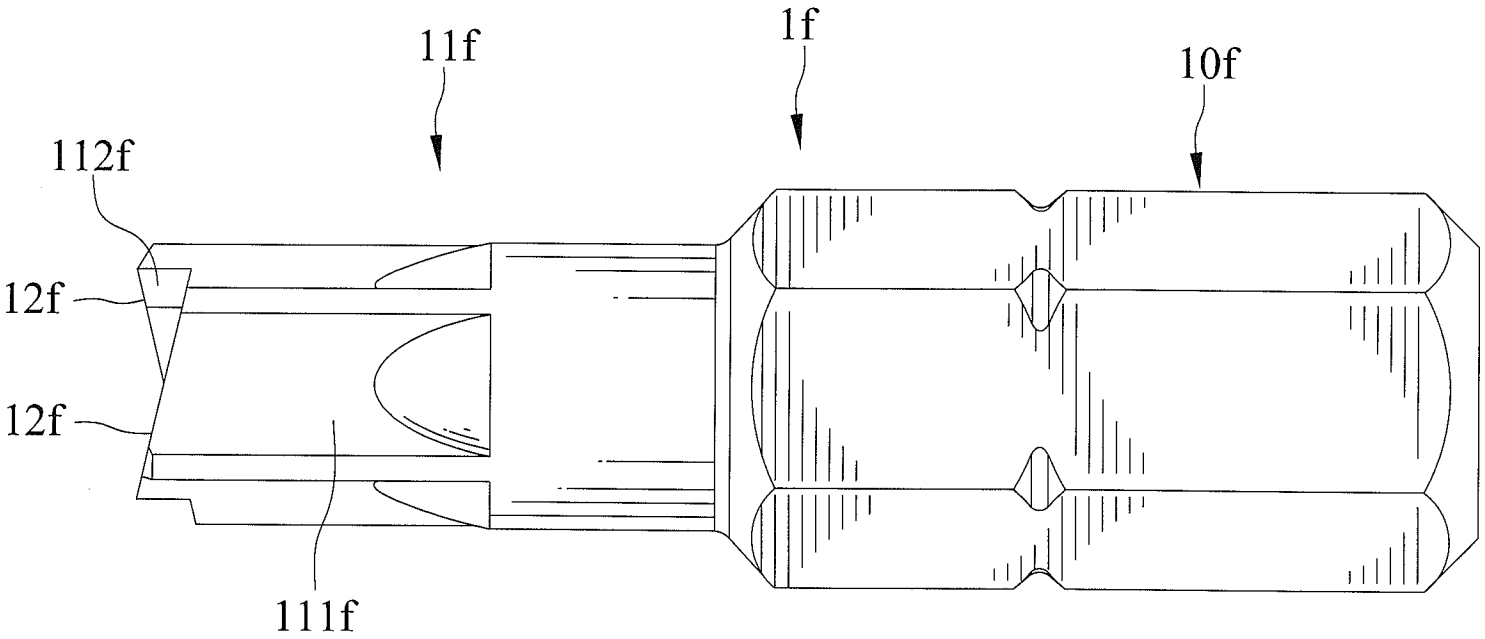
FIG. 20 shows a side view of the anti-slip fastener driver of FIG. 19.

FIGS. 19 and 20 show an anti-slip fastener driver 1*f* in accordance with a seventh embodiment of the present invention. The structure of the anti-slip fastener driver 1*f* of the seventh embodiment is substantially similar to that of the sixth embodiment except that the driving portion 11*f* includes two driving sections 1101*f*. Each driving section 1101*f* includes three peripheral faces 111*f* and a proximal face 112*f*. Each peripheral face 111*f* is a curved face. The proximal faces 112*f* of the two driving sections 1101*f* are not connected to each other. One end of each driving section 1101*f* of the driving portion 11*f* opposite to the body portion 10*f* has a contact face 12*f*. The two contact faces 12*f* together form an end face of the distal end of the driving portion 11*f* with a height difference provided therebetween. In particular, the two contact faces 12*f* are beveled faces and respectively connect with the two proximal faces 112*f* of the two driving sections 1101*f*.

Figure 21:
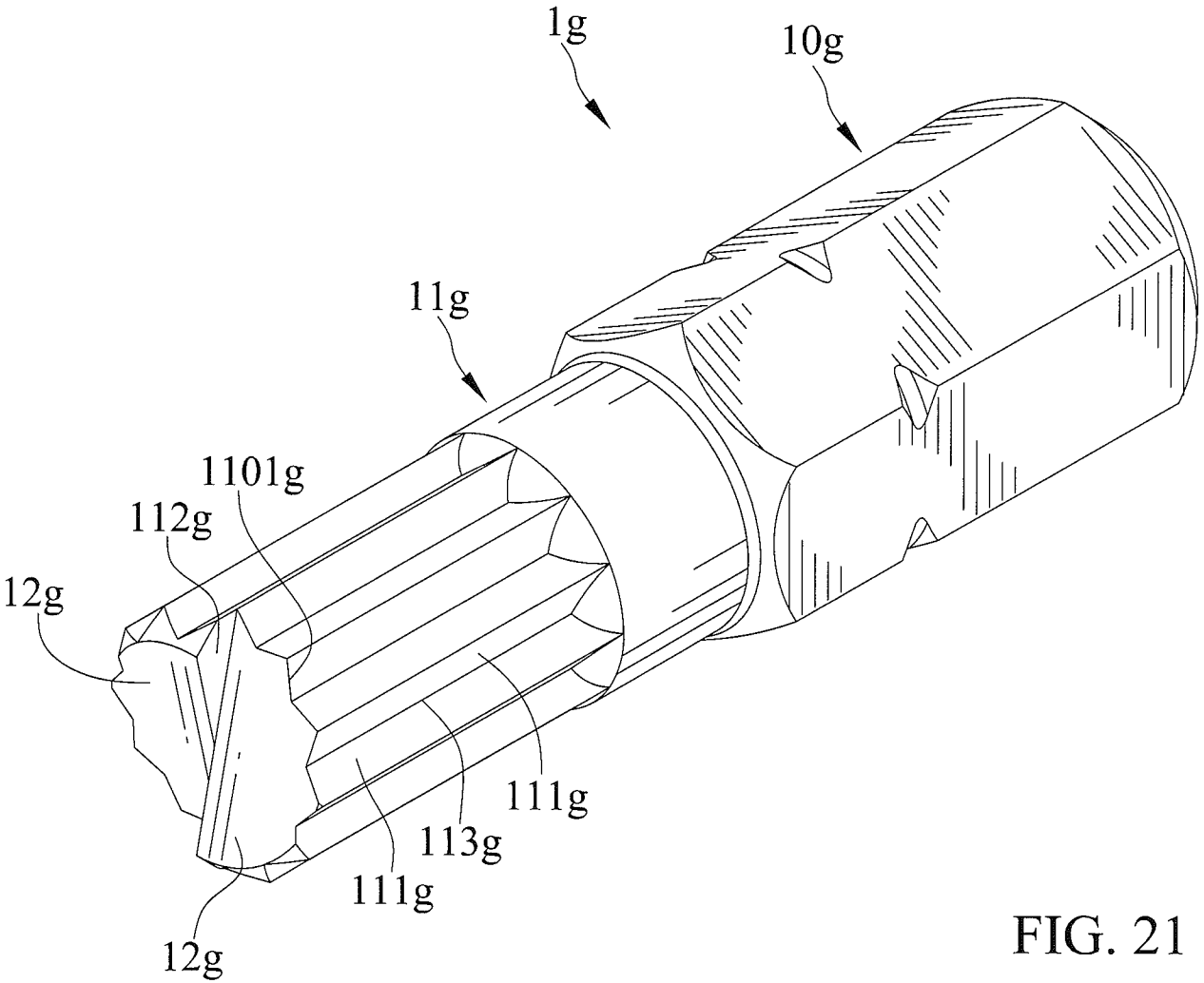
FIG. 21 shows a perspective view of an anti-slip fastener driver in accordance with an eighth embodiment of the present invention.
Figure 22:
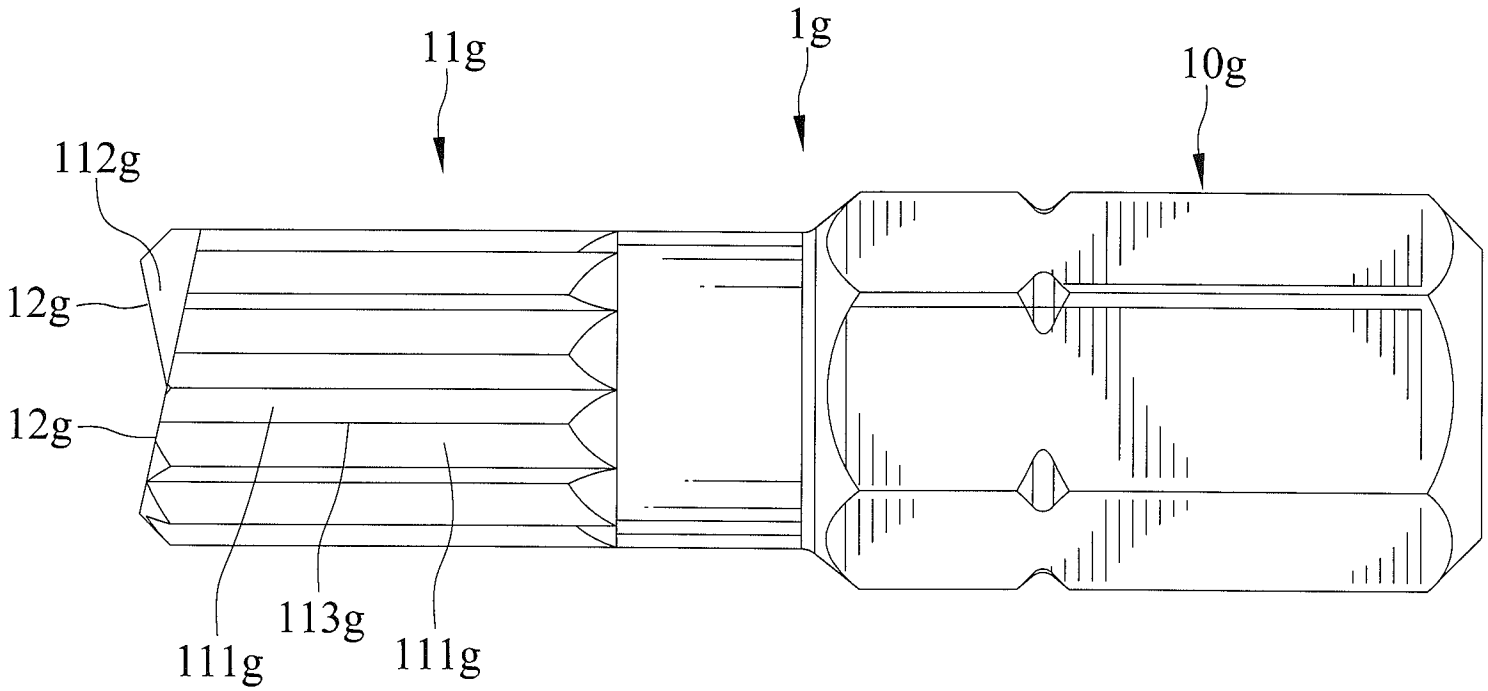
FIG. 22 shows a side view of the anti-slip fastener driver of FIG. 21.

FIGS. 21 and 22 show an anti-slip fastener driver 1*g* in accordance with an eighth embodiment of the present invention. The structure of the anti-slip fastener driver 1*g* of the eighth embodiment is substantially similar to that of the sixth embodiment except that the driving portion 11*g* includes two driving sections 1101*g*. Each driving section 1101*g* includes a plurality of peripheral faces 111*g* and a proximal face 112*g*. Every two adjacent peripheral faces 111*g* form an obtuse angle and an engaging groove 113*g*. The proximal faces 112*g* of the two driving sections 1101*g* are connected to each other, and each proximal face 112*g* is at an acute angle to one of the plurality of peripheral faces 111*g*. One end of each driving section 1101*g* of the driving portion 11*g* opposite to the body portion 10*g* has a contact face 12*g*. The two contact faces 12*g* together form an end face of the distal end of the driving portion 11*g* with a height difference provided therebetween. In particular, each of the two contact faces 12*g* is a beveled face and at an inner included angle less than 90 degrees to the one of the plurality of peripheral faces 111*g* of each driving section 1101*g*.

Figure 23:
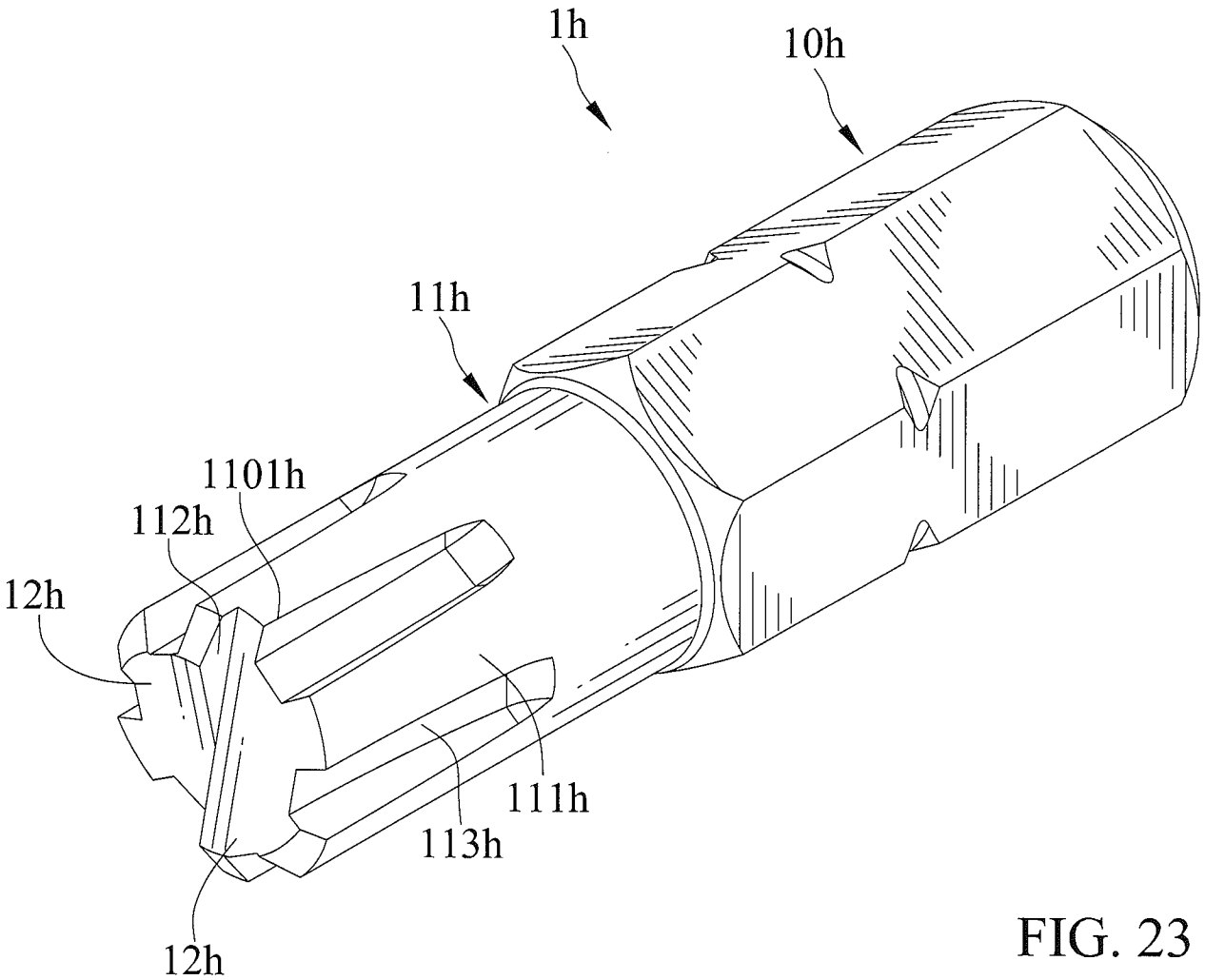
FIG. 23 shows a perspective view of an anti-slip fastener driver in accordance with a ninth embodiment of the present invention.
Figure 24:
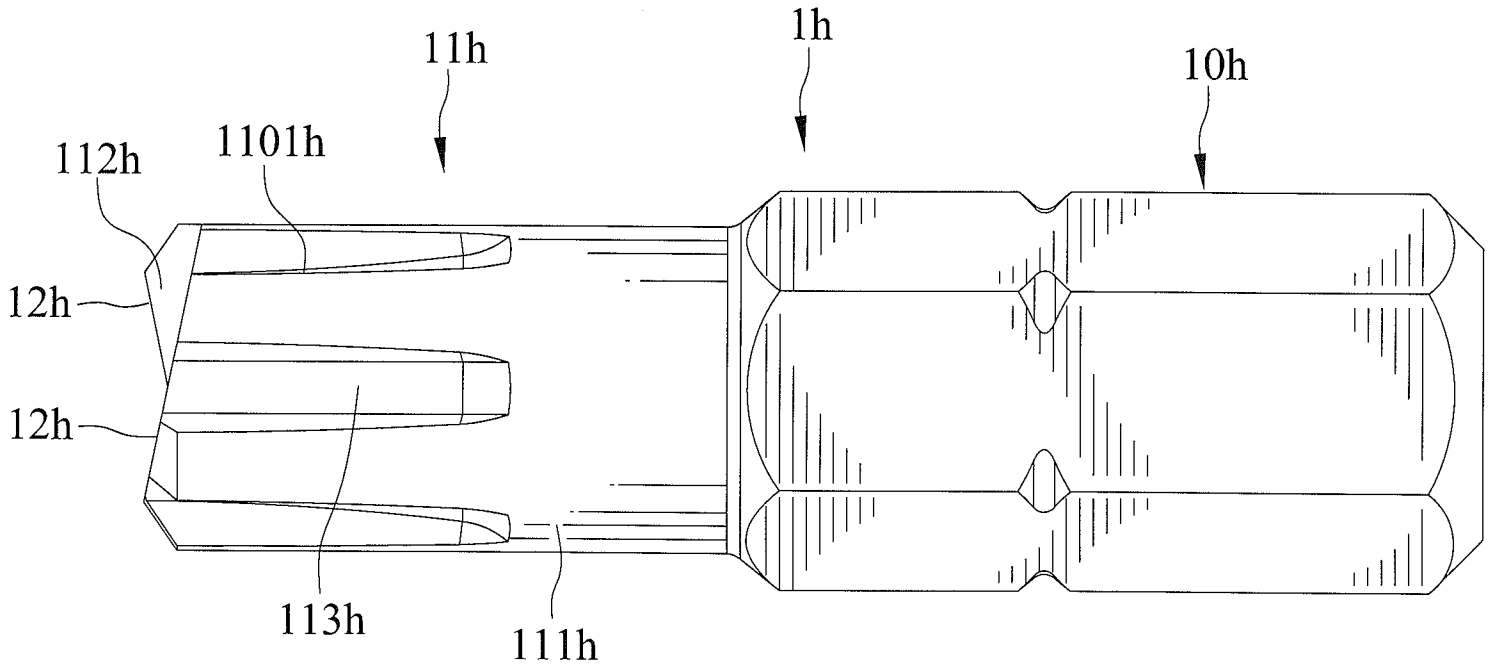
FIG. 24 shows a side view of the anti-slip fastener driver of FIG. 23.

FIGS. 23 and 24 show an anti-slip fastener driver 1*h* in accordance with a ninth embodiment of the present invention. The structure of the anti-slip fastener driver 1*h* of the ninth embodiment is substantially similar to that of the eighth embodiment except that the driving portion 11*h* includes two driving sections 1101*h*. Each driving section 1101*h* includes a peripheral face 111*h* and a proximal face 112*h*. Each peripheral face 111*h* is depressed to form a plurality of engaging grooves 113*h*. The proximal faces 112*h* of the two driving sections 1101*h* are connected to each other, and each proximal face 112*h* is at an acute angle to one of the plurality of peripheral faces 111*h*. One end of each driving section 1101*h* of the driving portion 11*h* opposite to the body portion 10*h* has a contact face 12*h*. The two contact faces 12*h* together form an end face of the distal end of the driving portion 11*h* with a height difference provided therebetween. In particular, each of the two contact faces 12*h* is a beveled face and connected with the plurality of engaging groove 113*h*. Moreover, each of the two contact faces 12*h* is at an inner included angle less than 90 degrees to each of the plurality of peripheral faces 111*h* of each driving section 1101*h*.

Based on the embodiments above, the anti-slip fastener drivers 1*d*, 1*e*, 1*f*, 1*g*, and 1*h* substantially are applied in screw bits.

In view of the forgoing, it is an object of the present invention to provide an anti-slip fastener driver 1, 1*a*, 1*b*, 1*c*, 1*e*, 1*f*, 1*g*, and 1*h* adapted for driving a damaged or stripped fastener 2.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. An anti-slip fastener driver comprising:

a body portion;

a driving portion formed at one terminal end of the body portion and including at least one peripheral face, with at least one contact face formed at one distal end of the driving portion opposite to the body portion, with the at least one contact face being at an inner included angle less than 90 degrees to the at least one peripheral face, with the at least one contact face including two contact faces, with a height difference provided between the two contact faces, with the driving portion including two driving sections each having three peripheral faces and a proximal face, with the proximal faces of the two driving sections connected to each other, with one end of each driving section opposite to the body portion forming the contact face, with the two contact faces together forming an end face of the distal end of the driving portion, with the two contact faces being beveled and inclined to each other, with each of the two contact faces being at the inner included angle less than 90 degrees to one of the three peripheral faces of each driving section, with each of the two contact faces including three short sides respectively connecting with the three peripheral faces of each driving section, and a long side connecting with the proximal face of each driving section, with the long sides of the two contact faces together forming an outer included angle less than 90 degrees.

2. The anti-slip fastener driver as claimed in claim 1, with one end of the body portion opposite to the driving portion forming an auxiliary driving portion, with the auxiliary driving portion formed in a ball shape and having six exterior curved faces, with a neck portion formed between the auxiliary driving and body portions and having six interior curved faces respectively connected with the six exterior curved faces of the auxiliary driving portion.

3. An anti-slip fastener driver comprising:

a body portion;

a driving portion formed at one terminal end of the body portion and including at least one peripheral face, with at least one contact face formed at one distal end of the driving portion opposite to the body portion, with the at least one contact face being at an inner included angle less than 90 degrees to the at least one peripheral face, with the at least one contact face including two contact faces, with a height difference provided between the two contact faces, with the driving portion including two driving sections each having three peripheral faces, with a proximal face located between the two driving sections, with the proximal face and one of the three peripheral faces forming a right angle, with one end of each driving section opposite to the body portion forming the contact face, with the two contact faces together forming an end face of the distal end of the driving portion, with one of the two contact faces being beveled and at the inner included angle less the 90 degrees to one of the three peripheral faces of one of the two driving sections, with another of the two contact faces being flat and perpendicular to one of the three peripheral faces of the other driving section, with each of the two contact faces including three short sides respectively connecting with the three peripheral faces of each driving section, and a long side connecting with the proximal face of each driving section, with the long side of one of the two contact faces and the long side of the other of the two contact faces forming an outer included angle less than 90 degrees.

4. An anti-slip fastener driver comprising:

a body portion;

a driving portion formed at one terminal end of the body portion and including at least one peripheral face, with at least one contact face formed at one distal end of the driving portion opposite to the body portion, with the at least one contact face being at an inner included angle less than 90 degrees to the at least one peripheral face, with the at least one contact face including two contact faces, with a height difference provided between the two contact faces, with the driving portion including two driving sections and a middle section arranged between the two driving sections, with each driving section having three peripheral faces, with two proximal faces respectively formed in two opposite sides of the middle section, with one end of each driving section opposite to the body portion forming the contact face, with one end of the middle section opposite to the body portion having a spaced face, with the two contact faces and the spaced face forming an end face of the distal end of the driving portion together, with each of the two contact faces being beveled and at the inner included angle less the 90 degrees to one of the three peripheral faces of each driving section, with the spaced face being flat and perpendicular to one of the three peripheral faces of one of the two driving sections, with each of the two contact faces including three short sides respectively connecting with the three peripheral faces of each driving section, and a long side connecting with the two proximal faces of the middle section, with the long side of each contact face and each opposite side of the middle section forming an outer included angle less than 90 degrees.

5. An anti-slip fastener driver comprising:

a body portion, with the body portion including six outer walls, with one of a plurality of slots formed between every two adjacent outer walls;

a driving portion formed at one terminal end of the body portion and including at least one peripheral face, with at least one contact face formed at one distal end of the driving portion opposite to the body portion, with the at least one contact face being at an inner included angle less than 90 degrees to the at least one peripheral face, with the at least one contact face including two contact faces, with a height difference provided between the two contact faces, with the two contact faces being beveled, with an inner included angle between one of the two contact faces and the at least one peripheral face of the driving portion being less than 90 degrees, with the driving portion including two driving sections, with each driving section having three peripheral faces and a proximal face, with the proximal faces of the two driving sections connected to each other, with each proximal face and one of the three peripheral faces forming an acute angle, with one end of each driving section opposite to the body portion forming the contact face, with the two contact faces forming an end face of the distal end of the driving portion together, with the two contact faces being beveled and inclined to each other, with each of the two contact faces and one of the three peripheral faces of each driving section forming the inner included angle less than 90 degrees, with each of the two contact faces having three short sides respectively connecting with the three peripheral faces of each driving section, and a long side connecting with the proximal face of each driving section, with the long sides of the two contact faces including an outer included angle less than 90 degrees.

6. An anti-slip fastener driver comprising:

a body portion, with the body portion including six outer walls, with one of a plurality of slots formed between every two adjacent outer walls;

a driving portion formed at one terminal end of the body portion and including at least one peripheral face, with at least one contact face formed at one distal end of the driving portion opposite to the body portion, with the at least one contact face being at an inner included angle less than 90 degrees to the at least one peripheral face, with the at least one contact face including two contact faces, with a height difference provided between the two contact faces, with the two contact faces being beveled, with an inner included angle between one of the two contact faces and the at least one peripheral face of the driving portion being less than 90 degrees, with the driving portion including two driving sections, with each driving section having three peripheral faces and a proximal face, with each peripheral face being curved, with the proximal faces of the two driving sections connected to each other, with each proximal face and one of the three peripheral faces forming an acute angle, with one end of each driving section opposite to the body portion forming the contact face, with the two contact faces together forming an end face of the distal end of the driving portion, with the two contact faces being beveled and inclined to each other, with each of the two contact faces and the one of the three peripheral faces of each driving section forming the inner included angle less than 90 degrees, with each of the two contact faces having three short sides being arc shaped and respectively connecting with the three peripheral faces of each driving section, and a long side connecting with the proximal face of each driving section, with the two long sides of the two contact faces forming an outer included angle less than 90 degrees.

7. An anti-slip fastener driver comprising:

a body portion, with the body portion including six outer walls, with one of a plurality of slots formed between every two adjacent outer walls;

a driving portion formed at one terminal end of the body portion and including at least one peripheral face, with at least one contact face formed at one distal end of the driving portion opposite to the body portion, with the at least one contact face being at an inner included angle less than 90 degrees to the at least one peripheral face, with the at least one contact face including two contact faces, with a height difference provided between the two contact faces, with the two contact faces being beveled, with an inner included angle between one of the two contact faces and the at least one peripheral face of the driving portion being less than 90 degrees, with the driving portion including two driving sections, with each driving section having three peripheral faces and a proximal face, with each peripheral face being curved, with the proximal faces of the two driving sections not connected to each other, with one end of each driving section opposite to the body portion forming the contact face, with the two contact faces forming an end face of the distal end of the driving portion together, with the two contact faces being beveled and respectively connecting with the proximal faces of the two driving sections.

8. An anti-slip fastener driver comprising:

a body portion, with the body portion including six outer walls, with one of a plurality of slots formed between every two adjacent outer walls;

a driving portion formed at one terminal end of the body portion and including at least one peripheral face, with at least one contact face formed at one distal end of the driving portion opposite to the body portion, with the at least one contact face being at an inner included angle less than 90 degrees to the at least one peripheral face, with the at least one contact face including two contact faces, with a height difference provided between the two contact faces, with the two contact faces being beveled, with an inner included angle between one of the two contact faces and the at least one peripheral face of the driving portion being less than 90 degrees, with the driving portion including two driving sections, with each driving section including a plurality of peripheral faces and a proximal face, with every two adjacent peripheral faces forming an obtuse angle and an engaging groove, with the proximal faces of the two driving sections connected to each other, with each proximal face being at an acute angle to one of the plurality of peripheral faces, with one end of each driving section opposite to the body portion forming the contact face, with the two contact faces together forming an end face of the distal end of the driving portion, with each of the two contact faces being beveled and at the inner included angle less than 90 degrees to the one of the plurality of peripheral faces of each driving section.

9. An anti-slip fastener driver comprising:

a body portion, with the body portion including six outer walls, with one of a plurality of slots formed between every two adjacent outer walls;

a driving portion formed at one terminal end of the body portion and including at least one peripheral face, with at least one contact face formed at one distal end of the driving portion opposite to the body portion, with the at least one contact face being at an inner included angle less than 90 degrees to the at least one peripheral face, with the at least one contact face including two contact faces, with a height difference provided between the two contact faces, with the two contact faces being beveled, with an inner included angle between one of the two contact faces and the at least one peripheral face of the driving portion being less than 90 degrees, with the driving portion including two driving sections, with each driving section having a peripheral face and a proximal face, with each peripheral face depressed to form a plurality of engaging grooves, with the proximal faces of the two driving sections connected to each other, with each proximal face being at an acute angle to one of the plurality of peripheral faces, with one end of each driving section of the driving portion opposite to the body portion forming the contact face, with the two contact faces together forming an end face of the distal end of the driving portion, with each of the two contact faces being beveled and connected with the plurality of engaging grooves, with each of the two contact faces being at the inner included angle less than 90 degrees to each of the plurality of peripheral faces of each driving section.

* * * * *